US007163173B2

(12) United States Patent
Nakata et al.

(10) Patent No.: US 7,163,173 B2
(45) Date of Patent: Jan. 16, 2007

(54) METHOD OF AND APPARATUS FOR WINDING WEB

(75) Inventors: Tomohiro Nakata, Minamiashigara (JP); Takayuki Fujiwara, Minamiashigara (JP); Matsuo Seto, Minamiashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/014,516

(22) Filed: Dec. 14, 2001

(65) Prior Publication Data

US 2002/0117573 A1 Aug. 29, 2002

(30) Foreign Application Priority Data

Dec. 22, 2000 (JP) ..... 2000-389747
Dec. 22, 2000 (JP) ..... 2000-389863

(51) Int. Cl.
*B65H 59/38* (2006.01)

(52) U.S. Cl. ..... 242/412; 242/413

(58) Field of Classification Search ..... 242/412, 242/413, 413.1, 413.2, 413.5, 530.3
See application file for complete search history.

(56) References Cited

U.S. PATENT DOCUMENTS 2,693,919 A 11/1954 Wutscher
3,871,598 A * 3/1975 Kataoka ..... 242/413.2
3,988,916 A 11/1976 McGeeney
4,163,180 A * 7/1979 Dowd ..... 318/6
4,238,084 A * 12/1980 Kataoka ..... 242/413.1
4,347,993 A * 9/1982 Leonard ..... 242/413.3
4,461,433 A * 7/1984 Kani ..... 242/412.3
4,480,799 A * 11/1984 Yano et al. ..... 242/412
4,508,284 A * 4/1985 Kataoka ..... 242/413.1
4,650,133 A * 3/1987 White et al. ..... 242/412.3
4,708,301 A * 11/1987 Kataoka ..... 226/44
4,729,520 A * 3/1988 Kataoka ..... 242/412.2
4,852,785 A * 8/1989 Bettendorf et al. ..... 226/42
4,880,175 A * 11/1989 Yamauchi et al. ..... 242/412.1
4,977,466 A 12/1990 Nakata
5,064,131 A 11/1991 van Biesen et al.
5,141,169 A * 8/1992 Sugioka ..... 242/413.1
5,277,378 A 1/1994 Ebisawa
5,367,471 A * 11/1994 Nguyen et al. ..... 360/74.3
5,437,417 A * 8/1995 Kammann ..... 242/541.1
5,484,499 A * 1/1996 Marschke ..... 156/193
5,842,660 A 12/1998 Knaus
5,941,473 A * 8/1999 Kawano et al. ..... 242/413.1
6,089,496 A * 7/2000 Dorfel ..... 242/541.5
6,357,691 B1 * 3/2002 Watanabe et al. ..... 242/545.1

FOREIGN PATENT DOCUMENTS

DE 4321112 A1 * 1/1994
EP 1 063 190 A2 12/2000
JP 48-38149 11/1973

(Continued)

OTHER PUBLICATIONS

Patent Abstract of Japan, 11059985, Mar. 3, 1999.

(Continued)

*Primary Examiner*—Kathy Matecki
*Assistant Examiner*—Sang Kim
(74) *Attorney, Agent, or Firm*—Sughrue Mion, PLLC

(57) ABSTRACT

When an elongate film is initially wound around a core, it is wound under a low winding tension command value T1 corresponding to the length of the core. Then, after the tension is progressively increased at a predetermined rate, the elongate film is wound while its tension is gradually lowered from a high winding tension command value T3.

10 Claims, 22 Drawing Sheets

FOREIGN PATENT DOCUMENTS

| | | | | |
|---|---|---|---|---|
| JP | 57-40052 | | | 8/1982 |
| JP | 57195072 | A | * | 11/1982 |
| JP | 60-112562 | | | 6/1985 |
| JP | 60112562 | A | * | 6/1985 |
| JP | 60-191953 | | | 9/1985 |
| JP | 60191953 | A | * | 9/1985 |
| JP | 62116453 | A | * | 5/1987 |
| JP | 62153046 | A | * | 7/1987 |
| JP | 63242419 | A | * | 10/1988 |
| JP | 63267649 | A | * | 11/1988 |
| JP | 02106548 | A | * | 4/1990 |
| JP | 03128864 | A | * | 5/1991 |
| JP | 04280756 | | | 10/1992 |
| JP | 06071337 | A | * | 3/1994 |
| JP | 10-25043 | | | 1/1998 |
| JP | 11-59985 | | | 3/1999 |

OTHER PUBLICATIONS

Patent Abstract of Japan, 60112562, Jun. 19, 1985.
Patent Abstract of Japan, 55040196, Mar. 21, 1980.
Japanese Utility Model Application No. 45-128638.

* cited by examiner

METHOD OF AND APPARATUS FOR WINDING WEB

BACKGROUND OF THE INVENTION

1. Field of the Invention

The present invention relates to a method of and an apparatus for winding a web around a core.

2. Description of the Related Art

It has been known in the art to wind a web such as an elongate film or sheet of paper around a core to produce a high-quality roll which is free of wrinkles and edge undulations or irregularities by winding the web in intimate contact with a contact pressure roller to prevent air from being entrapped in the web as it is wound, thus producing the roll in a well wound state (see Japanese laid-open patent publication No. 11-59985).

According to the known process, since the contact pressure roller is held in direct contact with the web, it tends to degrade the quality of the web particularly if the web is a delicate material such as a film.

There has been proposed in the art a process of winding a web in a manner to prevent the quality of the web from being lowered and also to prevent the web from developing wrinkles. According to the proposed process, the web is wound under a low tension which is 70% or less of the basic winding tension in an initial web winding stage, and, when the number of turns of the web becomes 1/10 of the number of turns which is to be finally achieved, the winding tension is sharply returned to the high tension, after which the web is wound under a progressively decreasing tension (see Japanese laid-open patent publication No. 60-112562).

The above proposed process is disadvantageous in that since the winding tension is sharply changed from the low tension to the high tension, the web is subjected to an excessive load and liable to be deteriorated under the excessive load applied thereto. Furthermore, as shown in FIG. 22 of the accompanying drawings, because possible deformation of a core a around which a web f is wound is not taken into account, an end face b of the wound web f may possibly develop edge undulations or irregularities depending on the tension which is applied to the web d while it is being wound. Specifically, if the web a is curved while the web f is being wound, the web f is shifted axially of the core a, producing edge undulations or irregularities on the end face b. Such edge undulations or irregularities cause variations in the width L of the produced roll. Therefore, when the roll is supplied to a subsequent process of packaging the roll in a light-shielded state, the roll may not be packaged well in the light-shielded state for desired performance and may possibly suffer fogging due to exposure to light. In addition, the roll may not well fit an image forming apparatus such as an image setter or the like, e.g., may not be inserted into a magazine which is to be loaded into the image forming apparatus.

A film rewinding machine for automatically winding an elongate film on a core and a cutting machine for cutting a wide raw film into an elongate film of given width and then automatically winding the elongate film on a core employ a winding mechanism for supporting the elongate film on the outer circumferential surface of the core when the core is rotated in a winding position.

As disclosed in Japanese patent publication No. 57-40052 (hereinafter referred to as "prior art 1"), the winding mechanism has a holder for holding a spool, angularly movably mounted on the distal end of a belt wrapper, and an actuating mechanism for reciprocally moving the belt wrapper until the central axis of the spool held by the holder is aligned with the central axis of a winding barrel.

A strip coiler disclosed in Japanese utility model publication No. 48-38149 (hereinafter referred to as "prior art 2") comprises a mandrel for winding a strip as a coil, a plurality of wrapper rolls and wrapper roll plates disposed around the mandrel, and a fluid pressure cylinder for pressing the wrapper rolls into and retracting the wrapper rolls from a position to start winding the strip.

According to the prior art 1, the belt wrapper has an opening aligned with the direction in which the film enters, i.e., the direction in which the film tension acts. Therefore, when the elongate film is wound around the core (spool), the core may possibly be greatly flexed under the film tension. If the core is flexed, then the film tension concentrates on the opposite edges of the core, causing the elongate film to run unstably and disturbing the wound configuration of the elongate film.

According to the prior art 2, the strip coiler is designed for the purpose of setting a gap between the mandrel (corresponding to the core) and each wrapper roll depending on the thickness of the strip (corresponding to the elongate film) to be wound in order to keep the strip as it starts to be wound in a good coil configuration. The strip coiler has nothing incorporated therein for preventing the mandrel from being flexed under the strip tension. Stated otherwise, no consideration is given to achieving a balance between the strip tension and the force to press the wrapper rolls, and hence the strip tension tends to act on the mandrel to cause the mandrel to be flexed.

According to the prior art 2, furthermore, gaps are provided between the mandrel and the wrapper rolls and wrapper roll plates, and the strip is wound on the mandrel through the gaps. However, when the elongate film is wound around the core in this manner, the elongate film has difficulty in being held in intimate contact with the outer circumferential surface of the core, and the wound configuration becomes unstable on the end faces of the wound film roll.

SUMMARY OF THE INVENTION

It is a general object of the present invention to provide a method of and an apparatus for winding a web around a core in a highly neatly wound state without causing damage to the web and forming edge undulations or irregularities on end faces of a roll that is produced of the wound web.

A major object of the present invention is to provide a method of winding a web smoothly and highly accurately around a core in a simple process.

Another object of the present invention is to provide an apparatus for winding a web while reliably preventing the core from being flexed with a simple arrangement.

With a method of and an apparatus for winding a web around a core according to the present invention, the web is wound to a given length around the core under a low tension thereby imparting prescribed rigidity to the core without deforming the core. The length to which the web is wound under the low tension is set so as to correspond to the length of the core, thus preventing a quality failure such as a stepwise web shift on a shorter core.

Then, after the tension of the web is progressively increased at a predetermined rate, the tension is reduced at a predetermined rate while the web is being wound around the core. The web is thus wound around the core to which sufficient rigidity is imparted, without being subjected to an excessive load. As a result, a roll produced by winding the web around the core is free of edge undulations or irregularities on its end faces, and is of a good quality free of damage and winding irregularities.

In a method of winding a web around a core according to the present invention, a web is supported on the outer circumferential surface of a core by a plurality of rollers, and the core is rotated with a gap being defined by blocks for the passage of the web between the blocks and the outer circumferential surface of the core. The rollers and the blocks are retracted from the core successively from regions where a leading end of the web has passed. After the web is wound around the core by at least one turn, all the rollers and the blocks are retracted from the core.

Since the rollers and the blocks are retracted from the core successively from regions where the leading end of the web has passed, only the leading end of the web is held when the web is initially wound around the core. Therefore, the web is not loosened on the outer circumferential surface of the core under the tension of the web. As a consequence, a high-quality wound product with a desired wound configuration maintained reliably can efficiently be obtained through a simple process.

In an apparatus for winding a web around a core according to the present invention, a winding mechanism for guiding the web around the core when the core is rotated has a movable pressing roller for pressing the web against the core to support the web thereon and for being pressed against the core in a direction opposite to the direction in which the tension of at least the web is applied, and a plurality of movable blocks for creating a gap for passage of the web between the movable blocks and an outer circumferential surface of the core.

The movable pressing roller presses the core in the direction opposite to the direction in which the tension of the web is applied, to keep the tension of the web and the pressing forces applied by the pressing roller in equilibrium. Consequently, when the web is wound around the core, the core is effectively prevented from being flexed under the tension of the web, making it possible to reliably obtain a stable wound configuration with a simple arrangement.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
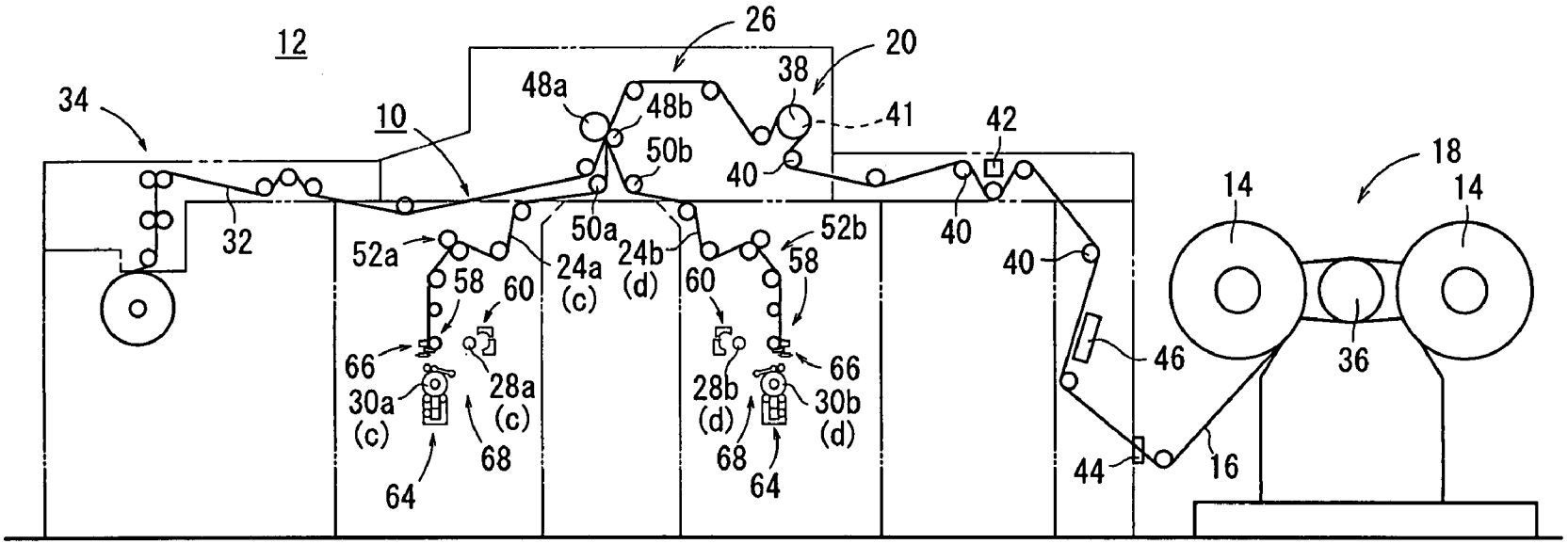
FIG. 1 is a schematic elevational view of a film processing and cutting machine to which a method of and an apparatus for winding a web around a core according to a first embodiment of the present invention are applied.

FIG. 1 shows in schematic elevation a film processing and cutting machine 12 which incorporates film (web) winding apparatus 10 according to a first embodiment of the present invention.

The film processing and cutting machine 12 has a film delivery apparatus 18 for rotating film rolls 14, each in the form of a photosensitive roll (hereinafter referred to as "film roll") of a PET (polyethylene terephthalate) film, a TAC (triacetylcellulose) film, a PEN (polyethylene naphthalate) film, or a photographic printing sheet used as a base, while being kept under suitable back tension to deliver an elongate raw film (raw web) 16; a feed apparatus 20 for feeding the elongate raw film 16 successively to next processes; a cutting apparatus 26 for cutting the elongate raw film 16 fed by the feed apparatus 20 at transversely spaced intervals into a plurality of elongate film blanks and cutting off film edges from the elongate film blanks, thus producing a plurality of elongate films (elongate webs) 24*a* through 24*d* (in the first embodiment, four elongate films 24*a* through 24*d* having given widths; film winding apparatus 10 for winding the elongate films 24*a* through 24*d* around respective cores 28*a* through 28*d* and cutting the elongate films 24*a* through 24*d* to given lengths, thereby producing rolls 30*a* through 30*d* as products; and an edge processing apparatus 34 for processing unwanted edges (film edges) 32 discharged from the elongate raw film 16.

The film delivery apparatus 18 has a turret shaft 36 by which a pair of film rolls 14 is supported for indexed movement. The film rolls 14 are selectively unwound by an unwinding motor (not shown). The feed apparatus 20 has a suction drum (reference roller) 38 serving as a main feed roller and a plurality of rollers 40. The suction drum 38 is controlled in speed to rotate according to a predetermined pattern of peripheral speeds by a servomotor (described later on). An encoder 41 is connected to the shaft (not shown) of the suction drum 38.

One of the rollers 40 which are disposed between the film roll 14 in operation and the suction drum 38 is associated with a tension detector (tension pickup) 42. The tension of the film between the film roll 14 and the suction drum 38 is controlled by the tension detector 42 and the unwinding motor mounted on the shaft of the film roll 14. Near the turret shaft 36, there are disposed an EPC (edge position control) sensor 44 for detecting the position of an end of the elongate raw film 16 to adjust the position of the end and a splicing suction table 46 for splicing the trailing end of the elongate raw film 16 to the leading end of a new elongate raw film 16 from the other film roll 14.

The cutting apparatus 26 has a plurality of rotary cutters 48*a*, 48*b* selectively positioned in cutting positions corresponding to film widths to be achieved, for cutting the elongate raw film 16 at transversely spaced intervals. The cutting apparatus 26 includes, in its lower portion, separation rollers 50*a*, 50*b* for separating severed elongate films 24*a* through 24*d* away from each other. The film winding apparatus 10 are disposed downstream of the separation rollers 50*a*, 50*b* with nip roller pairs 52*a*, 52*b* interposed therebetween.

In FIG. 1, there are two left and right film winding apparatus 10 associated with the elongate films 24*a* through 24*d*. The film winding apparatus 10 have a core rotating mechanism 58 for holding and rotating cores 28*a* through 28*d*, a plurality of block wrappers (winding mechanisms) 60 for winding the elongate films 24*a* through 24*d* to a given length around the cores 28*a* through 28*d* to produce rolls 30*a* through 30*d*, a product receiving mechanism 64 for gripping the circumferential surfaces of the elongate films 24*a* through 24*d* wound around the cores 28*a* through 28*d* while applying a certain tension to the elongate films 24*a* through 24*d*, the product receiving mechanism 64 being relatively movable away from the block wrappers 60, a cutting mechanism 66 for transversely cutting the elongate films 24*a* through 24*d* while they are being tensioned by the product receiving mechanism 64, and a core supply mechanism 68 for automatically supplying the cores 28*a* through 28*d* to the block wrappers 60.

Operation of the film processing and cutting machine 12 thus constructed will briefly be described below.

A film roll 14 mounted on the film delivery apparatus 18 is unwound by the non-illustrated unwinding motor to supply an elongate raw film 16 to the suction drum 38 of the feed apparatus 20. The speed of the suction drum 38 is controlled according to a given speed pattern by the servomotor, described later on, and the length of the elongate raw film 16 as it is fed (the length of the elongate raw film 16 as it is wound) is detected by the encoder 41.

The elongate raw film 16 which is adjusted in speed by the suction drum 38 is fed to the cutting apparatus 26. The rotary cutters 48*a*, 48*b* are rotated to cut the edges 32 off the elongate raw film 16 and produce four elongate films 24*a* through 24*d*, which are fed to the film winding apparatus 10.

In the film winding apparatus 10, while the outer circumferential surfaces of cores 28*a* through 28*d* are being held by the block wrappers 60, the suction drum 38 is rotated and the cores 28*a* through 28*d* are rotated by the core rotating mechanism 58. The elongate films 24*a* through 24*d* are now wound respectively around the cores 28*a* through 28*d*. After the block wrappers 60 are spaced away from the respective cores 28*a* through 28*d*, the elongate films 24*a* through 24*d* are wound to a given length around the cores 28*a* through 28*d*, producing rolls 30*a* through 30*d*.

The product receiving mechanism 64 is elevated to hold the rolls 30*a* through 30*d*, which are lowered as they are unwinding the elongate films 24*a* through 24*d*. The cutting mechanism 66 is actuated to cut (cross-cut) the elongate films 24*a* through 24*d* in their transverse direction. Now, products comprising the rolls 30*a* through 30*d* are obtained, and supplied to a next process. The block wrappers 60 are automatically supplied with new 28*a* through 28*d*, and restart a next winding process.

Figure 2:
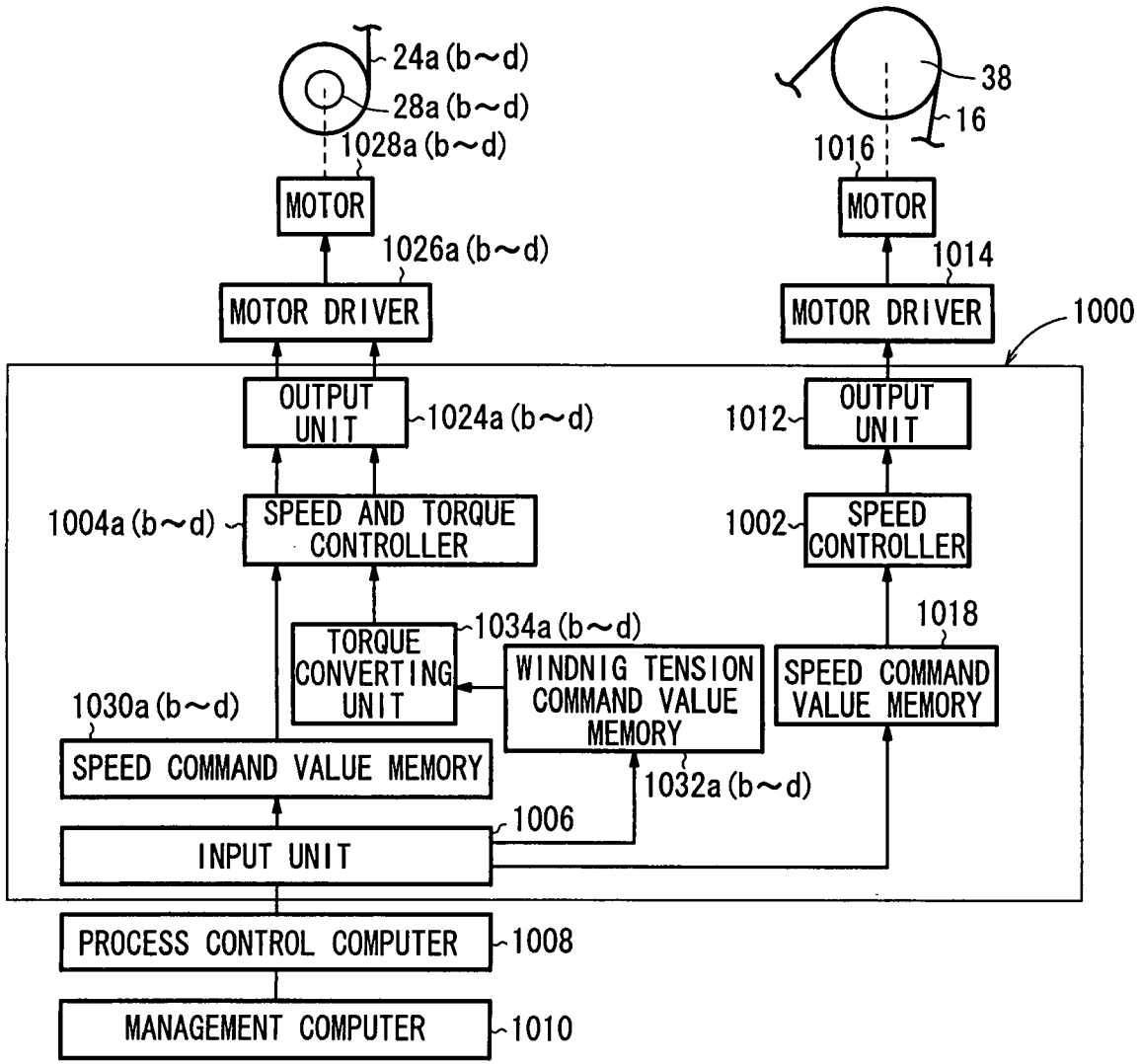
FIG. 2 is a block diagram of a control circuit of a film winding apparatus of the film processing and cutting machine shown in FIG. 1.

Unless the tension applied to the elongate films 24*a* through 24*d* is adjusted to an appropriate level when they are wound as described above, the elongate films 24*a* through 24*d* tend to be damaged due to excessive tension or the obtained rolls 30*a* through 30*d* are liable to be loosened or suffer edge undulations or irregularities. According to the first embodiment, these drawbacks are avoided by arranging and controlling the film winding apparatus 10 as follows:

FIG. 2 shows in block form a control circuit 1000 of the film winding apparatus 10. The control circuit 1000 has a speed controller 1002 for controlling the rotational speed of the suction drum 38, and speed and torque controllers (core rotation control means) 1004*a* through 1004*d* for controlling the rotational speeds and torques of the cores 28*a* through 28*d* in the core rotating mechanism 58.

A process control computer 1008 to which a management computer 1010 is connected is connected to the control circuit 1000 through an input unit 1006. The process control computer 1008 performs process control in the film winding apparatus 10. The film processing and cutting machine 12 has process control computers 1008 associated with respective processes. The management computer 1010 serves to manage all the process control computers 1008 of the film processing and cutting machine 12.

A motor driver 1014 is connected to the speed controller 1002 through an output unit 1012. The motor driver 1014 is also connected to a servomotor 1016 for rotating the suction drum 38. To the speed controller 1002, there is connected a speed command value memory 1018 for storing a speed command value supplied from the process control computer 1008. The servomotor 1016 is controlled according to the speed command value stored in the speed command value memory 1018. Motor drivers 1026*a* through 1026*d* are connected to the respective speed and torque controllers 1004*a* through 1004*d* through respective output units 1024*a* through 1024*d*. The motor drivers 1026*a* through 1026*d* are connected to respective servomotors 1028*a* through 1028*d* for winding elongate films 24*a* through 24*d* around cores 28*a* through 28*d*. To the speed and torque controllers 1004*a* through 1004*d*, there are connected respective speed command value memories 1030*a* through 1030*d* for storing speed command values supplied from the process control computers 1008, and respective winding tension command value memories (winding tension storing means) 1032*a* through 1032*d* for storing winding tension command values supplied from the process control computers 1008, through respective torque converting units (torque converting means) 1034*a* through 1034*d*. The servomotors 1028*a* through 1028*d* are controlled according to speed command values supplied from the speed and torque controllers 1004*a* through 1004*d* and winding tension command values converted by the torque converting units 1034*a* through 1034*d*.

A process of controlling the film winding apparatus 10, which is carried out by the control circuit 1000, will be described below.

Prior to a process of winding the elongate films 24*a* through 24*d* with the film winding apparatus 10, the process control computer 1008 stores preset speed command values and preset winding tension command values in the speed command value memory 1018, the speed command value memories 1030*a* through 1030*d*, and the winding tension command value memories 1032*a* through 1032*d*.

Figure 3:
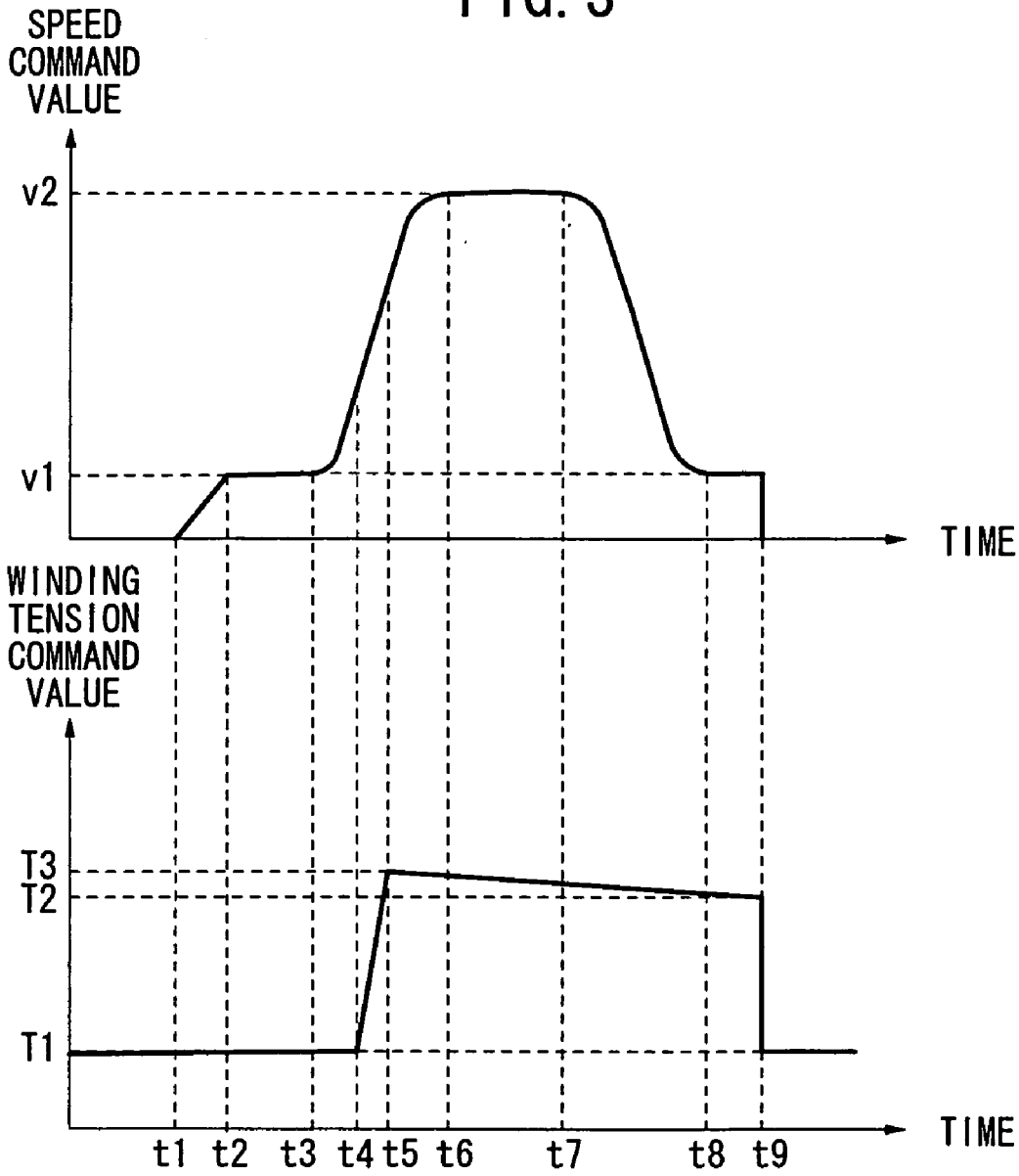
FIG. 3 is a diagram showing the relationship between speed command values for feeding a film and winding tension command values in the control circuit of the film winding apparatus of the film processing and cutting machine shown in FIG. 1.

FIG. 3 shows in an upper portion thereof the relationship between speed command values for the servomotor 1016 which are stored in the speed command value memory 1018 and time, and FIG. 3 shows in a lower portion thereof the relationship between winding tension command values for the elongate films 24*a* through 24*d* which are stored in the winding tension command value memories 1032*a* through 1032*d* and time. The speed command value memories 1030*a* through 1030*d* store a constant speed command value for the servomotors 1028*a* through 1028*d*.

The speed and torque controllers 1004*a* through 1004*d* read a constant speed command value from the speed command value memories 1030*a* through 1030*d*, supply a drive signal based on the speed command value from the output units 1024*a* through 1024*d* via the motor drivers 1026*a* through 1026*d* to the servomotors 1028*a* through 1028*d* to rotate the cores 28*a* through 28*d*.

The torque converting units 1034*a* through 1034*d* read a constant winding tension command value T1 shown in FIG. 3 from the winding tension command value memories 1032*a* through 1032*d*, convert the winding tension command value T1 into a torque command value, and supply the torque command value to the speed and torque controllers 1004*a* through 1004*d*. The speed and torque controllers 1004*a* through 1004*d* control the motor drivers 1026*a* through 1026*d* to rotate the servomotors 1028*a* through 1028*d* with the torque command supplied from the torque converting units 1034*a* through 1034*d*.

After the core rotating mechanism 58 has been adjusted to the above state, the speed controller 1002 reads a speed command value from the speed command value memory 1018 at a time t1, and supplies a drive signal based on the speed command value from the output unit 1012 via the motor driver 1014 to the servomotor 1016 thereby rotating the suction drum 38. The suction drum 38 is accelerated from the time t1 to a time t2, and then rotated at a constant speed v1 to deliver the elongate raw film 16 to the film winding apparatus 10.

The elongate raw film 16 delivered by the suction drum 38 is cut by the cutting apparatus 26 into four elongate films 24*a* through 24*d*, which are then supplied to the core rotating mechanism 58 of the film winding apparatus 10. Then, the elongate films 24*a* through 24*d* start being wound around the cores 28*a* through 28*d* that are rotated by the servomotors 1028*a* through 1028*d*. Since the servomotors 1028*a* through 1028*d* are controlled to produce a torque value which is equal to a constant torque command value that is obtained by converting the constant winding tension command value T1, a constant tension T1 is applied to the elongate films 24*a* through 24*d* when they are wound around the cores 28*a* through 28*d*.

Then, the speed controller 1002 reads a speed command value from the speed command value memory 1018, and accelerates the suction drum 38 from a speed v1 to a speed v2 in an interval from a time t3 to a time t6, delivering the elongate raw film 16 to the film winding apparatus 10.

The torque converting units 1034*a* through 1034*d* convert a winding tension command value, which gradually increases from the winding tension command value T1 read from the winding tension command value memories 1032*a* through 1032*d* to a winding tension command value T3 set depending on the length of the cores 28*a* through 28*d* during an interval from a time t4 to a time t5 which is set depending on the length of the cores 28*a* through 28*d*, into a torque command value. The speed and torque controllers 1004*a* through 1004*d* then supply the torque command value to the motor drivers 1026*a* through 1026*d* to control the servomotors 1028*a* through 1028*d*. As a result, the elongate films 24*a* through 24*d* are wound around the respective cores 28*a* through 28*d* under winding tensions T1 through T3 which gradually increase.

When a time t5 is reached, the speed and torque controllers 1004*a* through 1004*d* gradually reduce the torque command value from the value corresponding to the winding tension command value T3, and winds the elongate films 24*a* through 24*d*.

During this time, the acceleration to deliver the elongate raw film 16 with the servomotor 1016 based on the command from the speed controller 1002 is gradually reduced. At a time t6, the speed command value from the speed controller 1002 is set to a constant speed command value v2. The speed command value v2 is kept until a time t7, and thereafter reduced to the speed command value v1 at a time t8 and then to 0 at a time t9.

During an interval from the time t5 to the time 59, the speed and torque controllers 1004*a* through 1004*d* gradually reduce the torque command value from the value corresponding to the winding tension command value T3 to the value corresponding to the winding tension command value T2, and thereafter set the torque command value to the value corresponding to the winding tension command value T1.

The elongate films 24*a* through 24*d* are thus wound around the respective cores 28*a* through 28*d* while the tension applied to the elongate films 24*a* through 24*d* is being adjusted in the manner described above, thereby producing neatly wound rolls 30*a* through 30*d*.

Specifically, when the elongate films 24*a* through 24*d* start being wound around the respective cores 28*a* through 28*d*, the winding tension command value T1 applied to the elongate films 24*a* through 24*d* is kept low. Since no large external forces are imposed on the cores 28*a* through 28*d* which are not given sufficient rigidity by the elongate films 24*a* through 24*d*, the cores 28*a* through 28*d* are not flexed, and hence the elongate films 24*a* through 24*d* are neatly wound around the respective cores 28*a* through 28*d*.

When the elongate films 24*a* through 24*d* are wound to a certain length around the respective cores 28*a* through 28*d*, they impart rigidity to the cores 28*a* through 28*d*, making the cores 28*a* through 28*d* resistant to flexing. The tension of the elongate films 24*a* through 24*d* is then switched to the higher winding tension command value T3, allowing the elongate films 24*a* through 24*d* to be wound at a high speed around the cores 28*a* through 28*d* without being made unstable by becoming loose. For longer cores 28*a* through 28*d*, the length of the elongate films 24*a* through 24*d* wound under the lower winding tension command value T1 is set to a larger value, so that the elongate films 24*a* through 24*d* can be wound around the cores 28*a* through 28*d* without flexing the cores 28*a* through 28*d*.

For shorter cores 28*a* through 28*d*, since the shorter cores 28*a* through 28*d* are sufficiently rigid, the length of the elongate films 24*a* through 24*d* wound under the lower winding tension command value T1 is set to a smaller value, and the higher winding tension command value T3 switched from the lower winding tension command value T1 is set to a larger value. Thus, the elongate films 24*a* through 24*d* are prevented from being displaced while they are being wound, and can be neatly wound around the cores 28*a* through 28*d*.

In the first embodiment, when the winding tension command value is increased from the value T1 to the value T3, it is increased gradually at a certain rate without abrupt tension variations. Consequently, the elongate films 24*a* through 24*d* are wound around the respective cores 28*a* through 28*d* without being damaged.

After the tension of the elongate films 24*a* through 24*d* has reached the winding tension command value T3, the elongate films 24*a* through 24*d* are wound while their tension is being gradually reduced. In this manner, the elongate films 24*a* through 24*d* are wound without being displaced and the ends of the rolls 30*a* through 30*d* are not disturbed or undulated, so that the rolls 30*a* through 30*d* are in a held in a very neatly wound state.

The winding tension values stored in the winding tension command value memories 1032*a* through 1032*d* may be set to individual values for the respective rolls 30*a* through 30*d* and may be independently controlled.

Examples under specific conditions will be described below.

1st EXAMPLE

For winding elongate films 24*a* through 24*d* having a width of 1220 mm around respective cores 28*a* through 28*d* having a length of 1220 mm and an outside diameter of 3 inches, the elongate films 24*a* through 24*d* were wound to a length of 8 m (about 30 turns) under a tension T1=7.84 N/100 mm, and then wound to 10 m while increasing the tension from T1 to a tension T3=17.64 N/mm. Then, while gradually reducing the tension T3 at a rate of 20%, the elongate films 24*a* through 24*d* were wound to 61 m, producing rolls 30*a* through 30*d*. The number of turns wound under the low tension T1 was about 15% of the entire number of turns.

In 1st Example, though the cores 28*a* through 28*d* were elongate and liable to be flexed, any disturbance or undulation on the ends of the rolls 30*a* through 30*d* was less than a target value of 0.5 mm. The elongate films 24*a* through 24*d* were not displaced on the cores 28*a* through 28*d*, and sufficiently neatly wound around the respective cores 28*a* through 28*d*.

2nd EXAMPLE

For winding elongate films 24*a* through 24*d* having a width of 150 mm around respective cores 28 having a length of 150 mm and an outside diameter of 3 inches, the elongate films 24*a* through 24*d* were wound to about one-half of a turn around the cores 28*a* through 28*d* under a tension T1=7.84 N/100 mm, and then wound while increasing the tension from T1 to a tension T3=24.5 N/mm. Then, while gradually reducing the tension T3 at a rate of 20%, the elongate films 24*a* through 24*d* were wound to 61 m, producing rolls 30*a* through 30*d*. The number of turns wound under the low tension T1 was about 0.5% of the entire number of turns.

In 2nd Example, because the cores 28*a* through 28*d* were short and less liable to be flexed, the elongate films 24*a* through 24*d* could be wound under a high tension from the start of the winding process, producing neat rolls 30*a* through 30*d* whose elongate films 24*a* through 24*d* were not disturbed or undulated and displaced.

Other Examples are shown in Table 1 below. In these Examples, the cores 28*a* through 28*d* had an inside diameter of 73.7 mm, an outside diameter of 77.9 mm, and a length of which was 0.5 to 1.0 mm smaller than the width of the elongate films 24*a* through 24*d*. By setting the length of the elongate films 24*a* through 24*d* to be wound around cores 28*a* through 28*d* under the low tension T1 as shown in Table 1 with respect to the overall length of rolls 30*a* through 30*d*, any disturbance or undulation of the ends of the rolls could be held to an allowable range of 0.5 mm.

TABLE 1

| Axial film length | Winding ratio under low tension T1 |
|---|---|
| 310 mm | 0.5% |
| 381 mm | 0.5% |
| 761 mm | 0.5% |
| 838 mm | 0.5% |
| 1220 mm | 1.5% |

Figure 4:
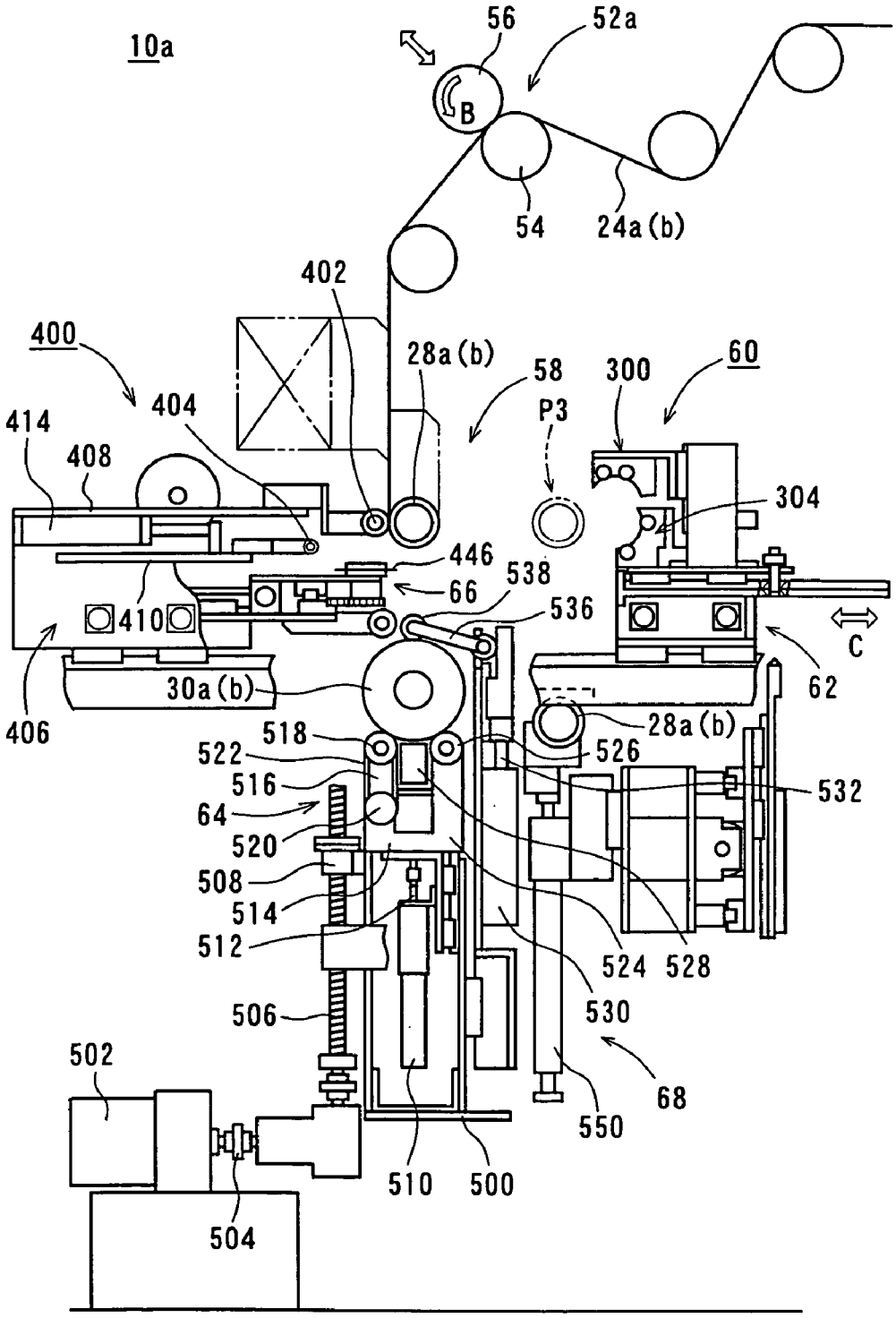
FIG. 4 is an elevational view of a film winding apparatus according to a second embodiment of the present invention.

FIG. 4 shows a film (web) winding apparatus 10*a* according to a second embodiment of the present invention. In a similar manner to the film winding apparatus 10 according to the first embodiment, the film winding apparatus 10*a* is incorporated in the film processing and cutting machine 12. Those parts of the film winding apparatus 10*a* which are identical to those of the film winding apparatus 10 are denoted by identical reference characters, and will not be described in detail below.

As shown in FIG. 4, a nip roller pair 52*a* comprises a backup roller 54 connected to a rotary actuator (not shown) and a nip roller 56 movable toward and away from the backup roller 54. The backup roller 54 has its peripheral speed set such that its feed speed in the direction indicated by the arrow B is higher than the suction drum 38. When the nip roller 56 is pressed against the backup roller 54 in sandwiching relation to the elongate films 24*a*, 24*b*, a certain tension is applied to elongate films 24*a*, 24*b* as they are fed into the cutting apparatus 26 though no tension is applied to the elongate films 24*a*, 24*b* downstream of the nip roller 56.

Figure 5:
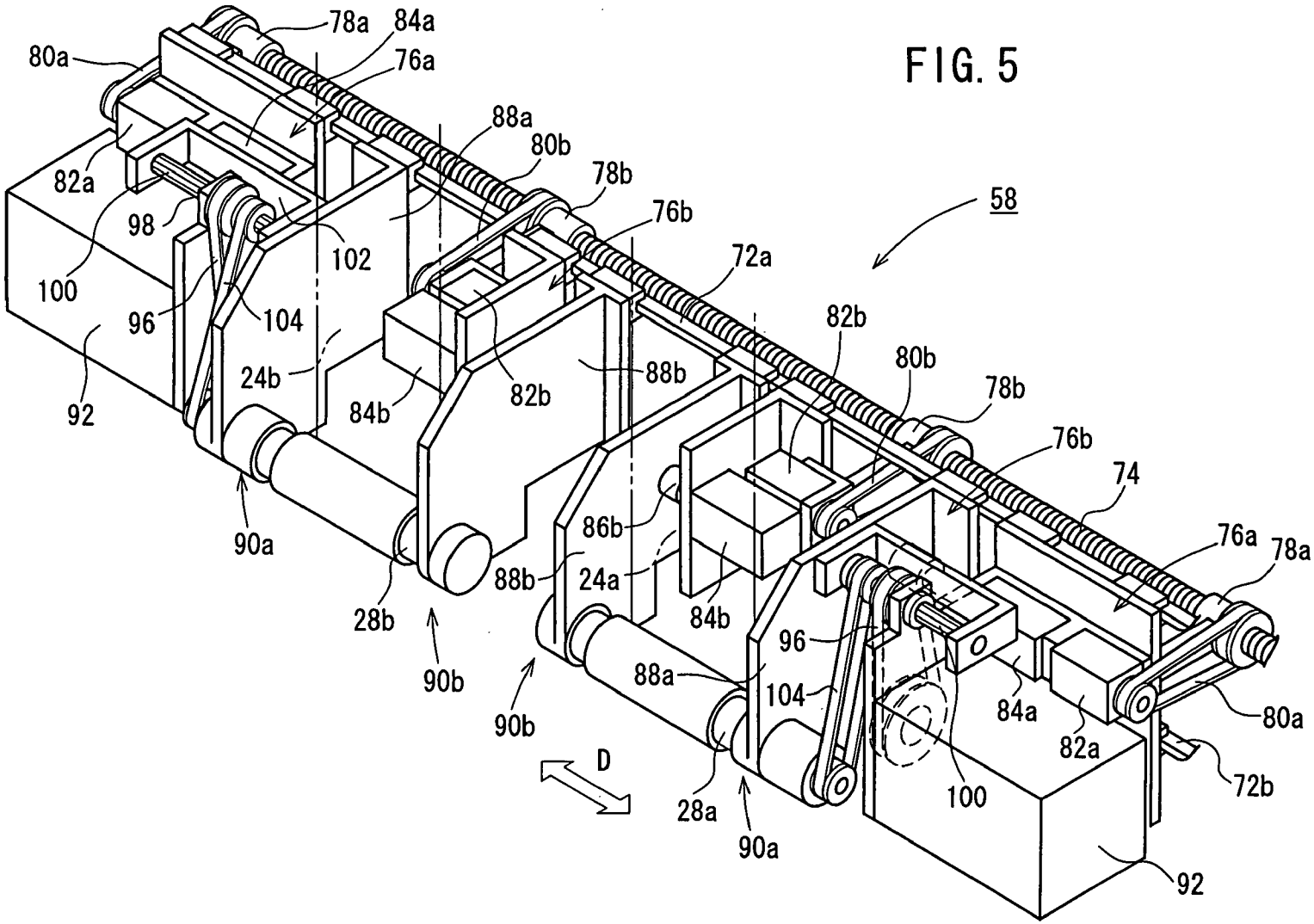
FIG. 5 is a perspective view of a core rotating mechanism of the film winding apparatus.

As shown in FIG. 5, the core rotating mechanism 58 has two cores 28*a*, 28*b* disposed coaxially with each other and positionally adjustable by two guide rails 72*a*, 72*b* and a ball screw 74 which extend in the directions indicated by the arrow D (axial directions of the cores 28*a*, 28*b* ) for simultaneously winding the elongate films 24*a*, 24*b* around the respective cores 28*a*, 28*b*.

Figure 6:
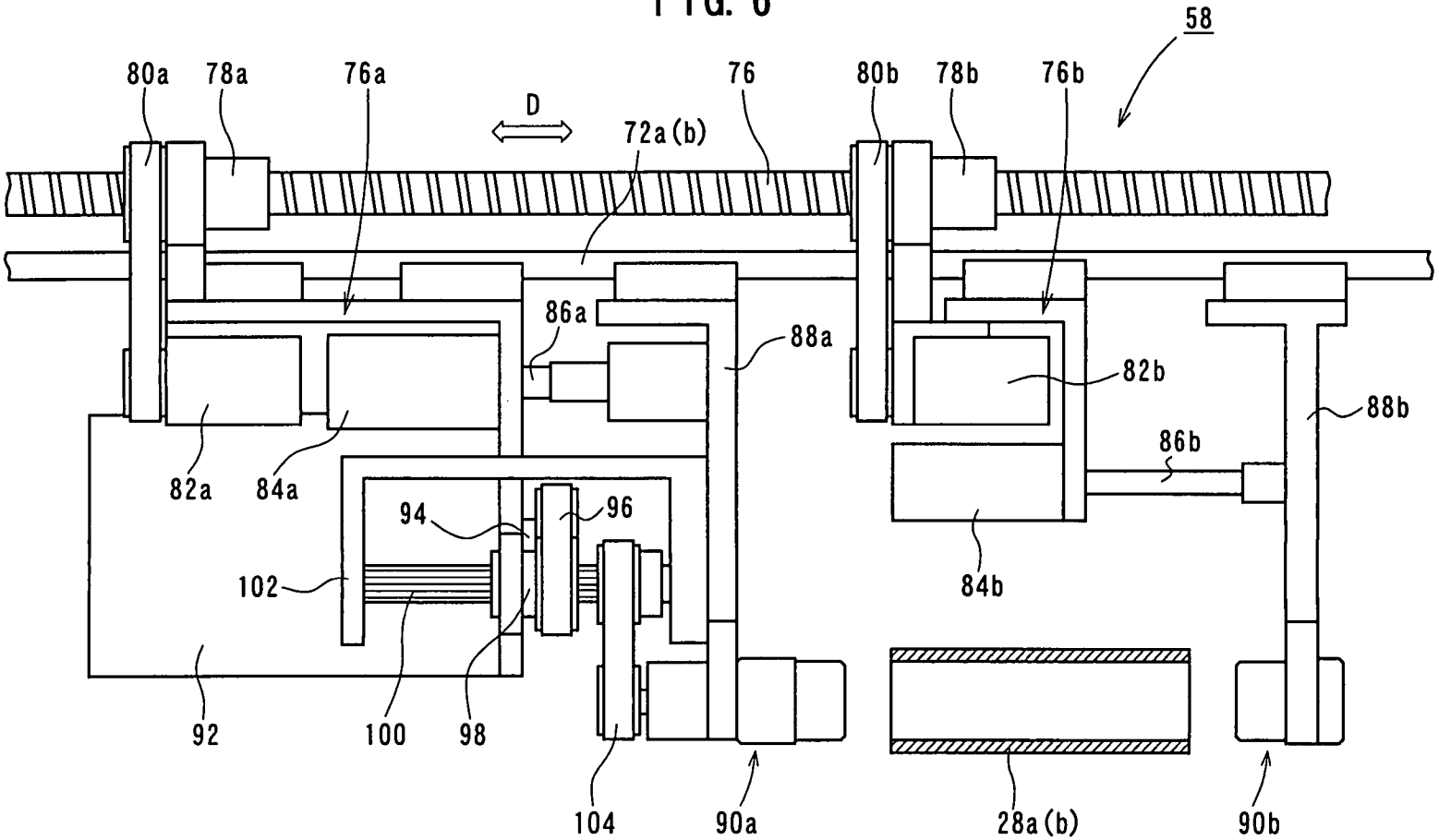
FIG. 6 is a plan view of the core rotating mechanism.

As shown in FIGS. 5 and 6, the core rotating mechanism 58 has two movable bases 76*a*, 76*b* supported on the guide rails 72*a*, 72*b* and the ball screw 74. The movable bases 76*a* 76*b* support thereon respective nuts 78*a*, 78*b* threaded over the ball screw 74 and respective servomotors 82*a*, 82*b* for rotating the respective nuts 78*a*, 78*b* individually through belt and pulley means 80*a*, 80*b*, respectively.

Cylinders 84*a*, 84*b* are fixed respectively to the movable bases 76*a*, 76*b* and have respective rods 86*a*, 86*b* projecting therefrom to which respective take-up arms 88*a*, 88*b* are secured. Core chucks 90*a*, 90*b* are rotatably mounted on the respective take-up arms 88*a*, 88*b*. The core chuck 90*a* can be rotated by a servomotor 92.

The servomotor 92 is fixedly mounted on the movable base 76*a* and has a drive shaft 94 to which a rotary tube 98 is coupled by a belt and pulley means 96. The rotary tube 98 is supported on the movable base 76*a* and has spline grooves defined in its inner circumferential surface, and a spline shaft 100 is fitted in the spline grooves. The spline shaft 100 is rotatably supported on a casing 102 fixed to the take-up arm 88*a*. The core chuck 90*a* is coupled to an end of the spline shaft 100 by a belt and pulley means 104.

Figure 7:
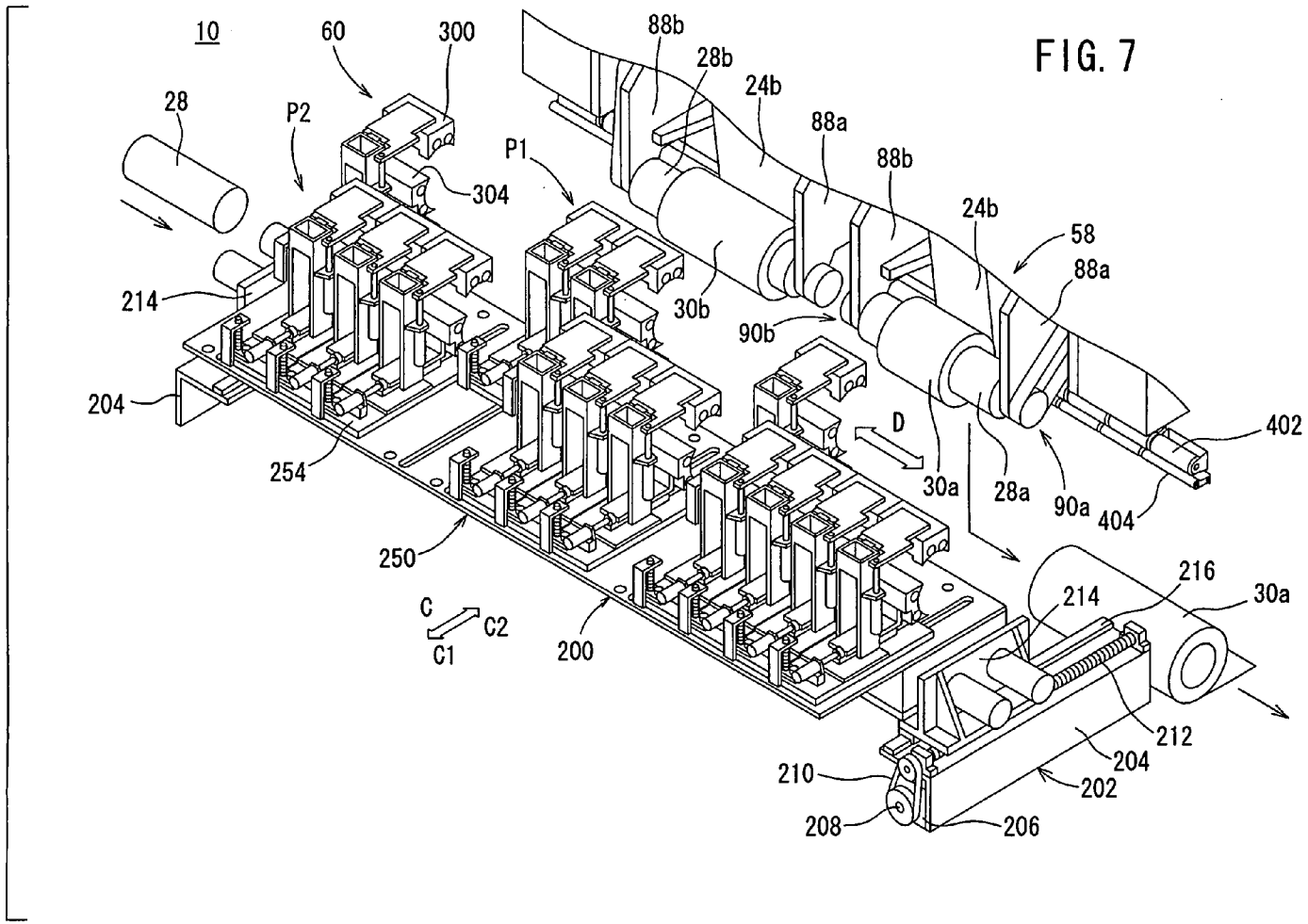
FIG. 7 is a perspective view of a block wrapper and a first unit body of a film winding mechanism.

As shown in FIG. 7, the block wrappers 60 are individually movable on a unit body 200 in the directions indicated by the arrow C which are transverse to the axial directions of cores 28*a*, 28*b* (the directions indicated by the arrow D). The unit body 200 is movable in the directions indicated by the arrow C by a drive means 202. The drive means 202 has a pair of frames 204 spaced from each other by a certain distance in the directions indicated by the arrow D. A servomotor 206 is mounted on at least one of the frames 204. The servomotor 206 has a drive shaft 208 to which a ball screw 212 is coupled through a belt and pulley means 210. The ball screws 212 are rotatably supported on upper surfaces of the frames 204, and are threaded through respective nuts (not shown) mounted on movable bodies 214. Each of the movable bodies 214 is supported on a guide rail 216 mounted on one of the frames 204.

The unit body 200 is removably fixed between the movable bodies 214. Each of the block wrappers 60 can be fixed to the unit body 200 selectively in a winding position P1 and a retracted position P2.

Figure 8:
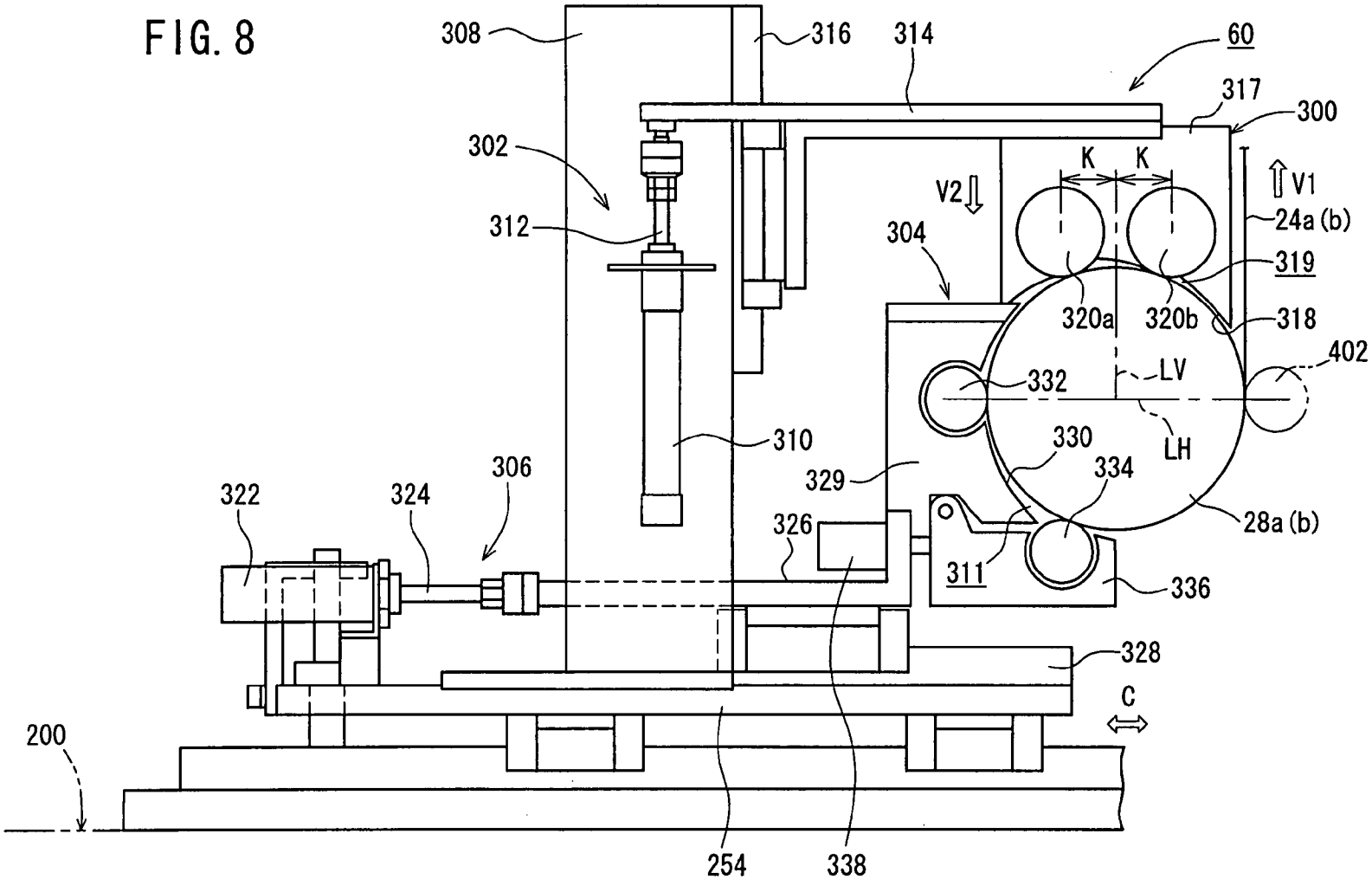
FIG. 8 is a side elevational view showing a structure of the block wrapper.

As shown in FIG. 8, the block wrappers 60 have respective upper wrappers 300 mounted on a base 254 and vertically movable by a lifting and lowering means 302, and side wrappers 304 mounted on the base 254 and horizontally movable by a moving means 306. The lifting and lowering means 302 has a rectangular support tube 308 mounted on the base 254 and extending vertically upwardly, and an actuator with a pressing force adjusting function in the form of a vertical cylinder 310, for example, is fixed to a side panel of the rectangular support tube 308. The cylinder 310 has an upwardly extending rod 312 to which there is fixed a vertically movable base 314 that is vertically movably supported on a guide rail 316 fixedly mounted another side panel of the rectangular support tube 308. Each of the upper wrappers 300 is mounted on the lower surface of a distal end portion of the vertically movable base 314.

Each of the upper wrappers 300 has a block 317 fixed to the vertically movable base 314. The block 317 has a guide surface 318 on its end close to the cores 28*a*, 28*b* which has a radius of curvature slightly greater than the radius of curvature of the outer circumferential surface of the cores 28*a*, 28*b*. A gap 319 for passing the elongate films 24*a*, 24*b* therethrough is defined between the guide surface 318 and the cores 28*a*, 28*b*. First and second free rollers (first and second pressing rollers) 320*a*, 320*b* are rotatably supported on the block 317 and positioned on the guide surface 318 for pressing the elongate films 24*a*, 24*b* against the outer circumferential surface of the cores 28*a*, 28*b*. The first and second free rollers 320*a*, 320*b* are movable toward and away from the cores 28*a*, 28*b* and can be pressed against the cores 28*a*, 28*b* in the direction indicated by the arrow V2 which is opposite to the direction indicated by the arrow V1 in which the elongate films 24*a*, 24*b* are tensioned.

The first and second free rollers 320*a*, 320*b* are symmetrically positioned with respect to a hypothetical reference line LV which extends parallel to the direction indicated by the arrow V1 in which the elongate films 24*a*, 24*b* are tensioned and also extends through centers of the cores 28*a*, 28*b*. Specifically, the first and second free rollers 320*a*, 320*b* are axially symmetrically positioned at equal distances K from the hypothetical reference line LV extending across the cores 28*a*, 28*b*.

The moving means 306 comprises an actuator with a pressing force adjusting function in the form of a horizontal cylinder 322, for example, mounted on the base 254. The cylinder 322 has a horizontally extending rod 324 to which there is fixed a movable base 326 that is supported on a rail 328 on the base 254 for movement in the directions indicated by the arrow C. Each of the side wrappers 304 is mounted on the movable base 326.

Each of the side wrappers 304 has a block 329 having a guide surface 330 on its end close to the cores 28*a*, 28*b* which has a radius of curvature slightly greater than the radius of curvature of the outer circumferential surfaces of the cores 28*a*, 28*b*. A gap 331 for passing the elongate films 24*a*, 24*b* therethrough is defined between the guide surface 330 and the cores 28*a*, 28*b*. Third and fourth free rollers 332, 334 are rotatably supported on the block 329 and positioned on the guide surface 330.

The third free roller 332 as a third pressing roller is disposed on a hypothetical line LH that extends diametrically across the cores 28*a*, 28*b* transversely to the hypothetical reference line LV. The fourth free roller 334 as a receiving roller is disposed in engagement with the cores 28*a*, 28*b* in substantially opposite relation to the first and second free rollers 320*a*, 320*b* about the cores 28*a*, 28*b*. The fourth free roller 334 is supported on a swing block 336 for angular movement with respect to the side wrapper 304. An air cylinder 338 as an air spring abuts against the swing block 336 for reliably holding the fourth free roller 334 against the cores 28*a*, 28*b* even if the cores 28*a*, 28*b* have a slightly different outside diameter.

Figure 9:
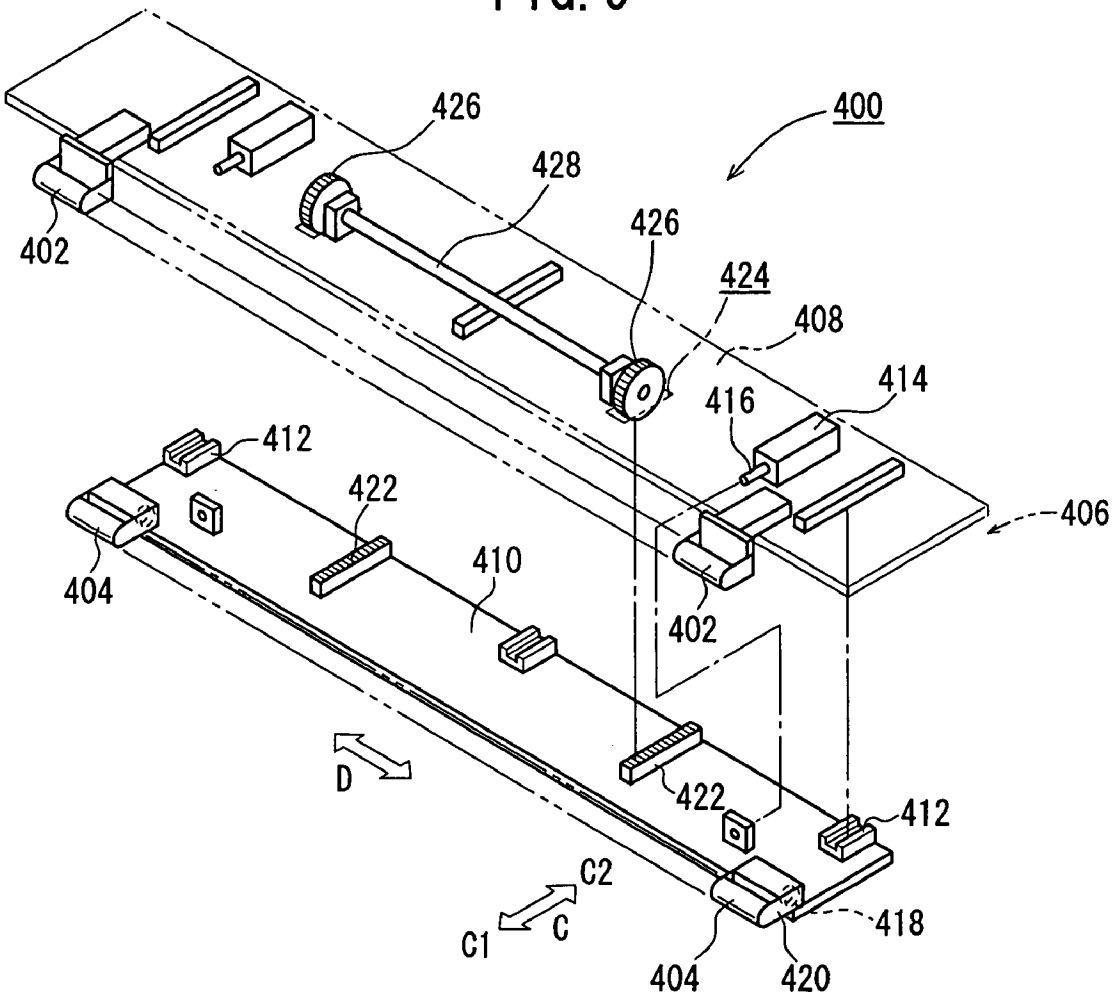
FIG. 9 is a perspective view of a winding nip roller unit of the film winding apparatus.

As shown in FIG. 4, a winding nip roller unit 400 serving as a winding mechanism is incorporated in a position confronting the block wrappers 60. As shown in FIGS. 4 and 9, the winding nip roller unit 400 comprises winding nip rollers (pressing rollers) 402 disposed in confronting relation to the third free roller 332 for pressing and supporting the elongate films 24*a*, 24*b* on the outer circumferential surface of the cores 28*a*, 28*b*, and lower winding rollers (pressing rollers) 404 for causing ends of the cut elongate films 24*a*, 24*b* to extend along the outer circumferential surfaces of the cores 28*a*, 28*b*. For example, 14 winding nip rollers 402 and 14 lower winding rollers 404 are arrayed in the directions indicated by the arrow D in association with the respective block wrappers 60.

An upper plate 408 is fixed to a unit body 406 of the winding nip roller unit 400, and the winding nip rollers 402 are individually rotatably mounted on the distal end of the upper plate 408. A movable lower plate 410 is disposed below the upper plate 408 for movement along a linear guide 412 in the directions indicated by the arrow C. A pair of cylinders 414 is fixed to the upper plate 408 and has rods 416 extending therefrom which are fixed to the lower plate 410.

A swing arm 420 is swingably supported on a distal end of the lower plate 410 by a spring 418. The lower winding rollers 404 are rotatably mounted on a distal end of the swing arm 420. A pair of racks 422 is fixed to the lower plate 410, and the upper plate 408 has openings 424 defined therein in alignment with the respective racks 422. Pinions 426 are held in mesh with the respective racks 422 through the openings 424. The pinions 426 are integrally supported by a rod 428.

Figure 10:
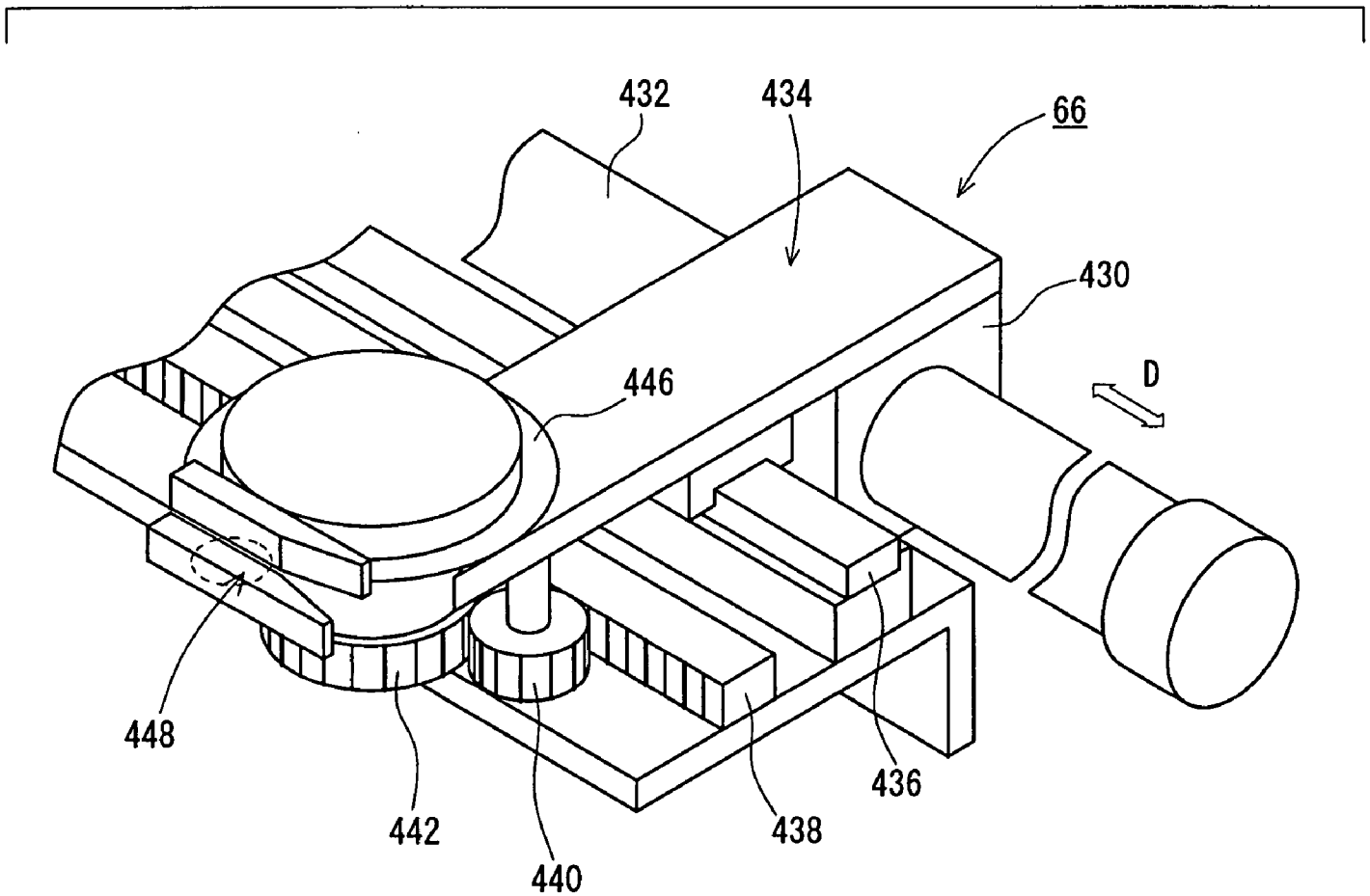
FIG. 10 is a perspective view of a cutting mechanism of the film winding apparatus.

The unit body 406 incorporates the cutting mechanism 66. As shown in FIGS. 4 and 10, the cutting mechanism 66 comprises a rodless cylinder 430 mounted on the unit body 406 by a rod 432 which extends axially of the cores 28*a*, 28*b* in the directions indicated by the arrow D. A base member 434 is fixed to the rodless cylinder 430 and guided along a linear guide 436 in the directions indicated by the arrow D. Parallel to the linear guide 436, there extends a rack 438 meshing with a first pinion 440 which is held in mesh with a second pinion 442.

A disk-shaped cross cutter blade 446 is fixed to the second pinion 442. A sorting guide 448 for guiding the elongate films 24*a*, 24*b* is disposed at a distal end of the cross cutter blade 446. The elongate films 24*a*, 24*b* may be cut off by the cross cutter blade 446 alone or the cross cutter blade 446 as an upper blade and a lower blade disposed in confronting relation to the upper blade. The rodless cylinder 430 may be replaced with a motor, a timing belt, and a pulley for moving the base member 434.

A free roller 450 supported on the unit body 406 is disposed below the cutting mechanism 66 (see FIG. 4).

As shown in FIG. 4, the product receiving mechanism 64 has a vertically movable frame 500 which can be stopped selectively in four positions, i.e., in an upper end position, an intermediate standby position, a film cutting position, and a lower end position, by a servomotor 502. The servomotor 502 has a drive shaft 504 operatively connected to a vertical ball screw 506 that is threaded through a nut 508 mounted on the vertically movable frame 500.

To the vertically movable frame 500, there is fixed a cylinder 510 having an upwardly extending rod 512 coupled to a block 514. A first arm 516 extends upwardly from the block 514 and supports on its distal end an ejection roller 518 to which a tensioning servomotor 520 is coupled by a belt and pulley means 522. The block 514 includes a second arm 524 with a free roller 526 rotatably supported on its distal end.

Between the first and second arms 516, 524, there is disposed a conveyor 528 for ejecting products. To the vertically movable frame 500, there is secured a cylinder 530 having an upwardly extending rod 532 to which a rider roller 538 is connected by a swing arm 536.

The core supply mechanism 68 has a pusher 550 of a comb-toothed structure having teeth aligned with the respective gaps between the block wrappers 60 for smoothly supplying cores 28*a*, 28*b* to a core transfer position P3.

Operation of the film winding mechanism 10*a* thus constructed will be described below.

Figure 11:
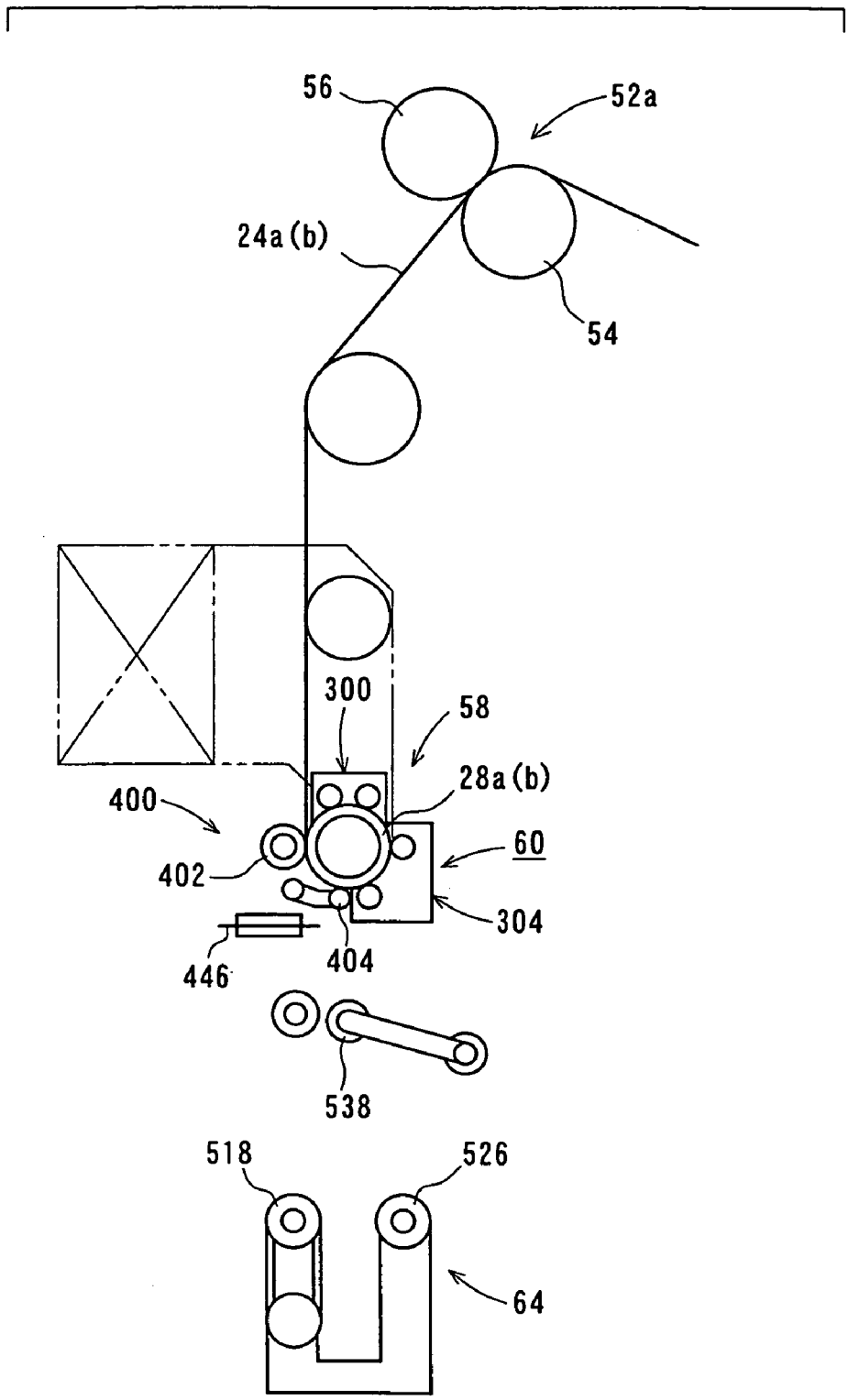
FIG. 11 is a view illustrative of the manner in which an elongate film starts being wound around a core.

When the elongate films 24*a*, 24*b* are wound around the cores 28*a*, 28*b* in the film winding apparatus 10*a*, as shown in FIG. 11, the cores 28*a*, 28*b* are placed in the winding position with their circumferential surface gripped by the block wrapper 60, and the opposite ends of the cores 28*a*, 28*b* are supported by the core chucks 90*a*, 90*b*.

In the winding nip roller unit 400, the unit body 406 is moved to move the winding nip roller 402 toward the cores 28*a*, 28*b*, thus supporting the elongate films 24*a*, 24*b* on the outer circumferential surfaces of the cores 28*a*, 28*b*. As shown in FIG. 9, the cylinder 414 is actuated to move the lower plate 410 forward in the direction indicated by the arrow C1 with respect to the upper plate 408, causing the lower winding roller 404 mounted on the lower plate 410 to wind the leading end portions of the elongate films 24*a*, 24*b* around the cores 28*a*, 28*b* through an angular range of about 90°.

Figure 12:
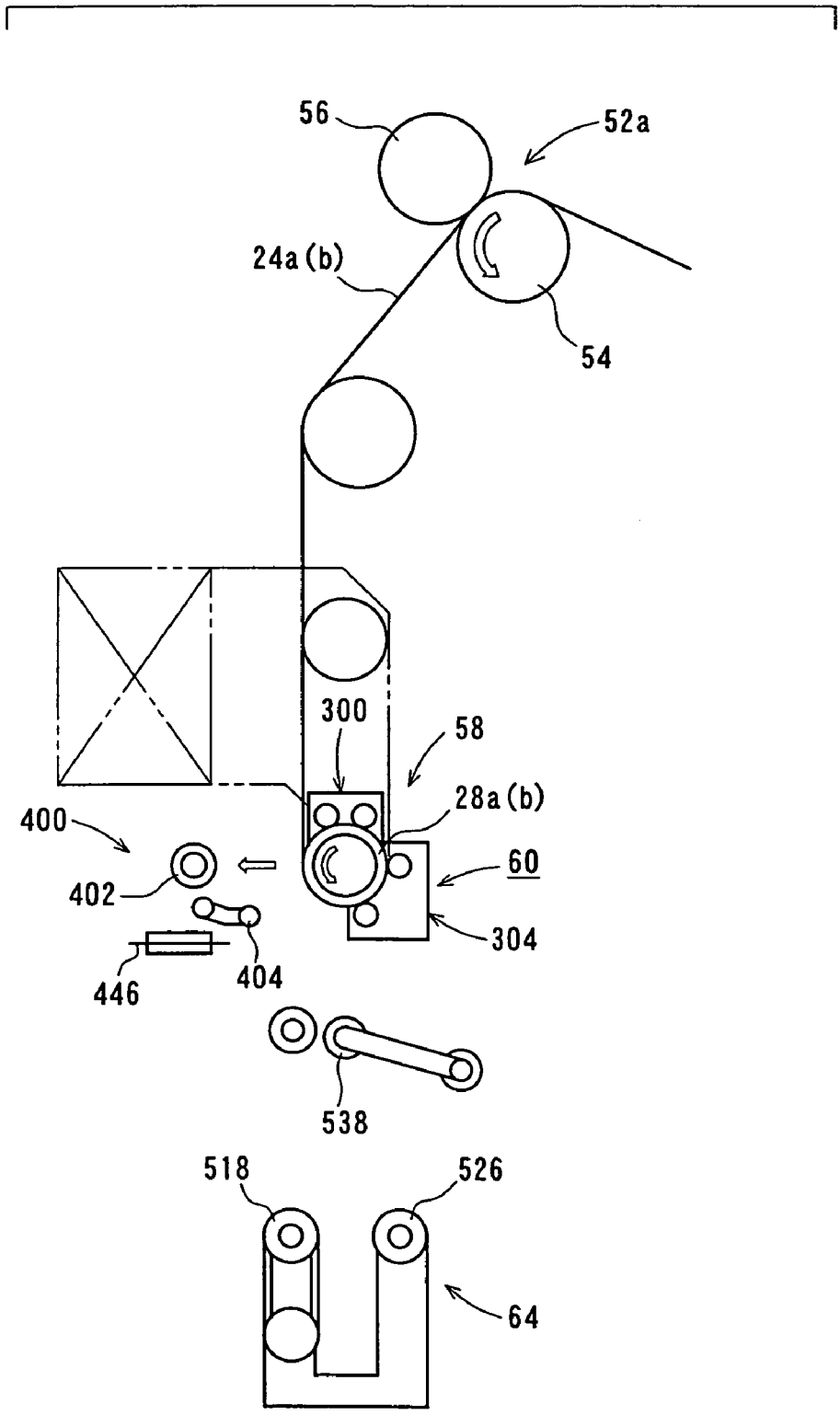
FIG. 12 is a view illustrative of the manner in which the winding nip roller unit is released from the core.

Then, the suction drum 38 is rotated, and the drive torque of the servomotor 92 enables the belt and pulley means 104 to start rotating the core chuck 90*a*, as shown in FIGS. 5 and 6. The cores 28*a*, 28*b* are now rotated to wind the elongate films 24*a*, 24*b* around the cores 28*a*, 28*b* through about 180° from the position where the elongate films 24*a*, 24*b* have been held by the lower winding roller 404 (the elongate films 24*a*, 24*b* are actually wound around the cores 28*a*, 28*b* through about 270°), after which the winding nip roller 402 and the lower winding roller 404 of the winding nip roller unit 400 are spaced away from the cores 28*a*, 28*b* (see FIG. 12).

Figure 13:
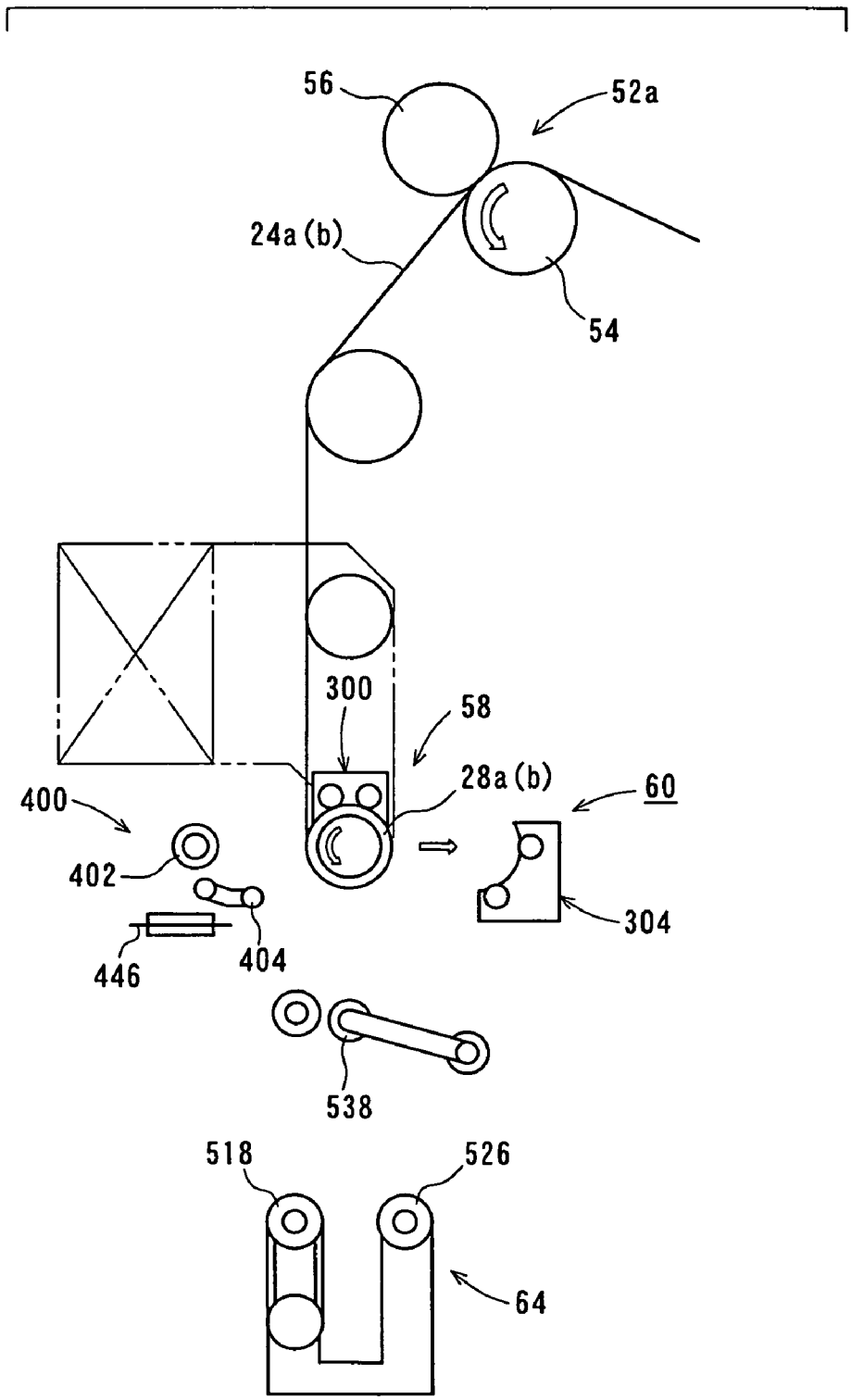
FIG. 13 is a view illustrative of the manner in which a side wrapper is released from the core.
Figure 14:
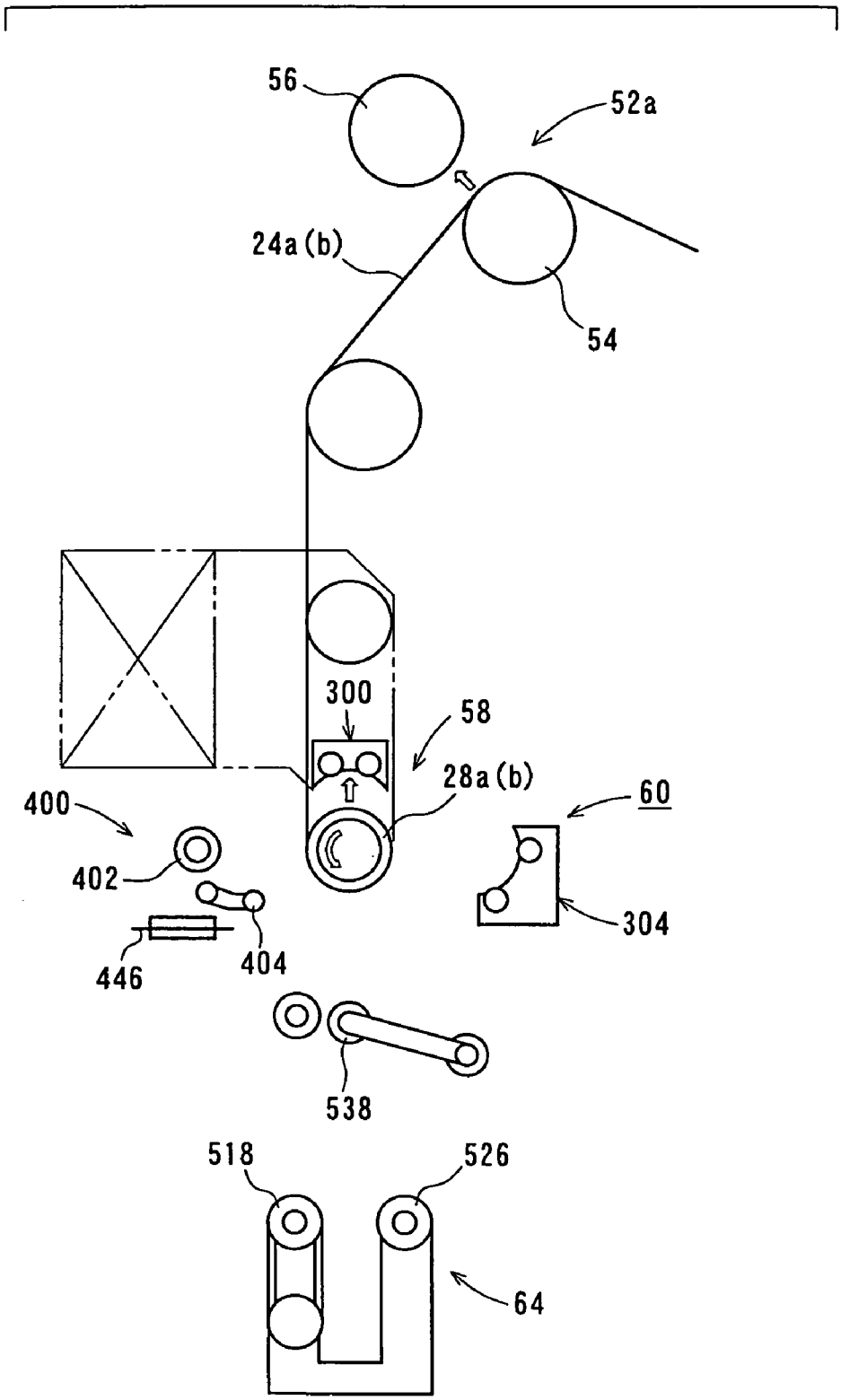
FIG. 14 is a view illustrative of the manner in which an upper wrapper is released from the core.

The servomotor 92 is energized to wind the elongate films 24*a*, 24*b* around the cores 28*a*, 28*b* further through about90° (a total of about 360°). Thereafter, as shown in FIG. 13, the side wrapper 38 of each block wrapper 60 is moved away from the cores 28*a*, 28*b* by the cylinder 322. When one turn or more of the elongate films 24*a*, 24*b* is subsequently wound around the cores 28*a*, 28*b*, as shown in FIG. 14, the upper wrapper 300 of each block wrapper 60 is retracted upwardly by the cylinder 310, and the nip roller 56 is spaced away from the backup roller 54.

As described above, when the elongate films 24*a*, 24*b* start being wound around the cores 28*a*, 28*b*, as shown in FIG. 11, the upper wrapper 300, the side wrapper 304, the winding nip roller 402, and the lower winding roller 404 of the winding mechanism are positioned around the cores 28*a*, 28*b*. Then, the core rotating mechanism 58 is actuated to rotate the cores 28*a*, 28*b* in the direction indicated by the arrow E in FIG. 12 to wind the elongate films 24*a*, 24*b* around the cores 28*a*, 28*b*, and the upper wrapper 300, the side wrapper 304, the winding nip roller 402, and the lower winding roller 404 are successively retracted from the cores 28*a*, 28*b*.

Specifically, after the elongate films 24*a*, 24*b* are wound around the cores 28*a*, 28*b* through about 180° from the position where the elongate films 24*a*, 24*b* have been held by the lower winding roller 404, the winding rip roller 402 and the lower winding roller 404 are spaced away from the cores 28*a*, 28*b*. After the elongate films 24*a*, 24*b* are wound around the cores 28*a*, 28*b* further through about 90°, the side wrapper 304 is spaced away from the cores 28*a*, 28*b*. When one turn or more of the elongate films 24*a*, 24*b* is subsequently wound around the cores 28*a*, 28*b* (e.g., through about 540°), the upper wrapper 300 is spaced away from the cores 28*a*, 28*b*.

Therefore, when the elongate films 24*a*, 24*b* are initially wound, the leading ends of the elongate films 24*a*, 24*b* are pressed against and supported by the first through fourth free rollers 320*a*, 320*b*, 332, 334 of the block wrapper 60, without sagging in the gaps 319, 331 between the blocks 317, 329 and the cores 28*a*, 28*b*. Stated otherwise, since the elongate films 24*a*, 24*b* are wound around the cores 28*a*, 28*b* with only their leading end being held in position, the elongate films 24*a*, 24*b* are prevented from sagging under their tension, making it possible to efficiently produce high-quality rolls 30*a*, 30*b* in a desired wound configuration that is reliably maintained through a simple process.

The times at which the upper wrapper 300, the side wrapper 304, the winding nip roller 402, and the lower winding roller 404 are moved are set based on the output signal from the encoder 41 that is coupled to the suction drum 38 which serves as a reference roller. The wound state of the elongate films 24*a*, 24*b* around the cores 28*a*, 28*b* can be accurately detected, and the wrappers and the rollers can optimally be retracted based on the detected wound state of the elongate films 24*a*, 24*b*, effectively avoiding winding failures of the elongate films 24*a*, 24*b*. Consequently, the elongate films 24*a*, 24*b* can smoothly be wound around the cores 28*a*, 28*b* in a stable wound configuration, producing high-quality rolls 30*a*, 30*b*.

Figure 15:
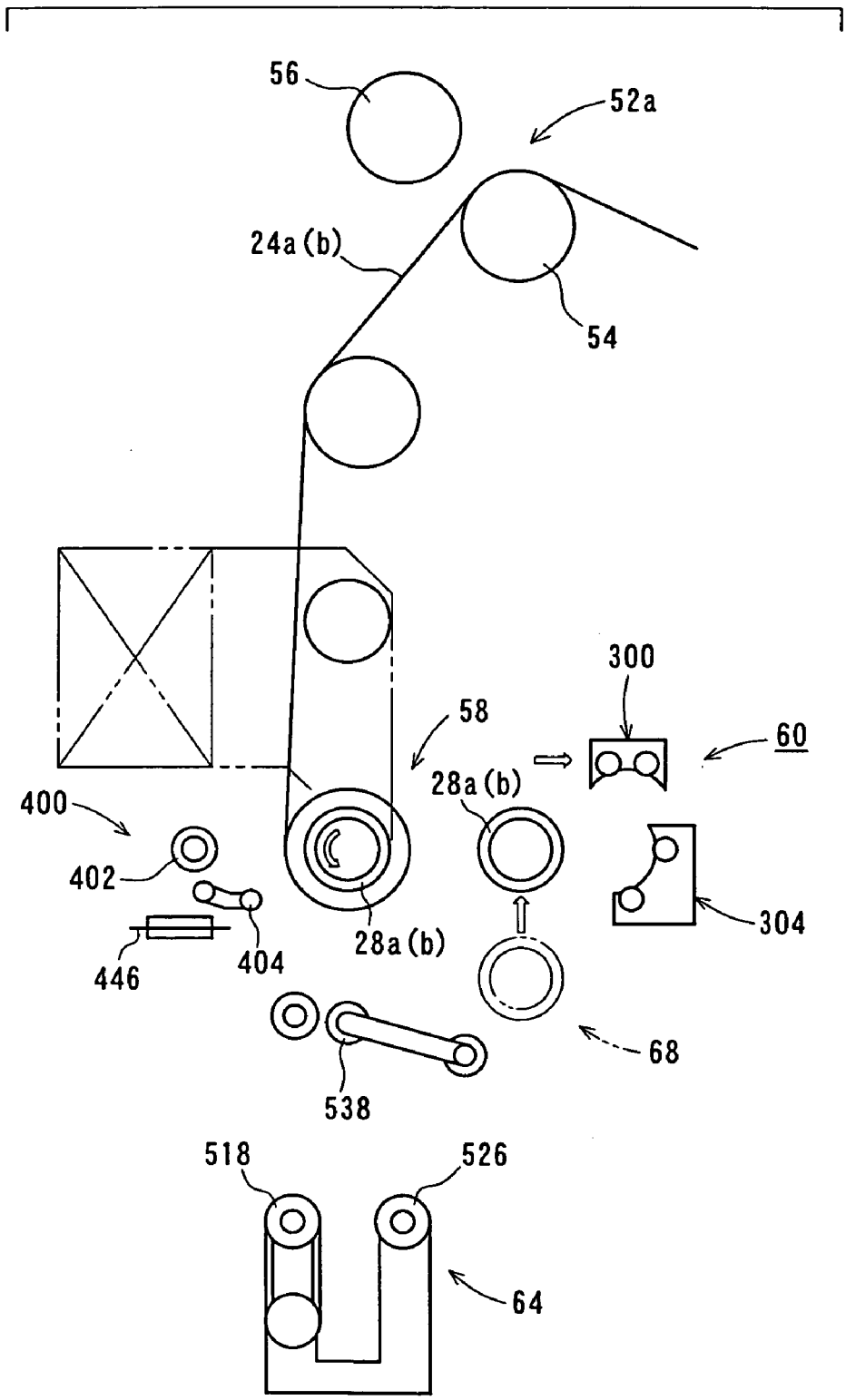
FIG. 15 is a view illustrative of the manner in which the elongate film is wound around the core.

While the elongate films 24*a*, 24*b* are being wound around the cores 28*a*, 28*b* by the core rotating mechanism 58, the unit body 200 on which the block wrappers 60 are mounted is temporarily moved in a direction away from the cores 28*a*, 28*b*, i.e., in the direction indicated by the arrow C1 in FIG. 7, by the ball screw 212 that is rotated by the servomotor 206 through the belt and pulley means 210. As shown in FIG. 15, the pusher 550 of the core supply mechanism 68 holds new cores 28*a*, 28*b* and moves upwardly, and places the new cores 28*a*, 28*b* in the core transfer position P3.

When the new cores 28*a*, 28*b* are placed in the core transfer position P3, a given number of block wrappers 60 positioned along the axial length of the cores 28*a*, 28*b* are moved in unison with each other to the core transfer position P3 by the unit body 200. Thereafter, as shown in FIG. 8, the cylinder 310 of the lifting and lowering means 302 is actuated to lower the upper wrapper 300 to support upper portions of the cores 28*a*, 28*b*. Then, the core supply mechanism 68 releases the cores 28*a*, 28*b*, and the cylinder 322 of the moving means 306 is actuated to move the side wrapper 304 forward, supporting side and lower portions of the cores 28*a*, 28*b* (see FIG. 16). The pusher 550 is lowered, thereby transferring the new cores 28*a*, 28*b* to the block wrappers 60.

Figure 16:
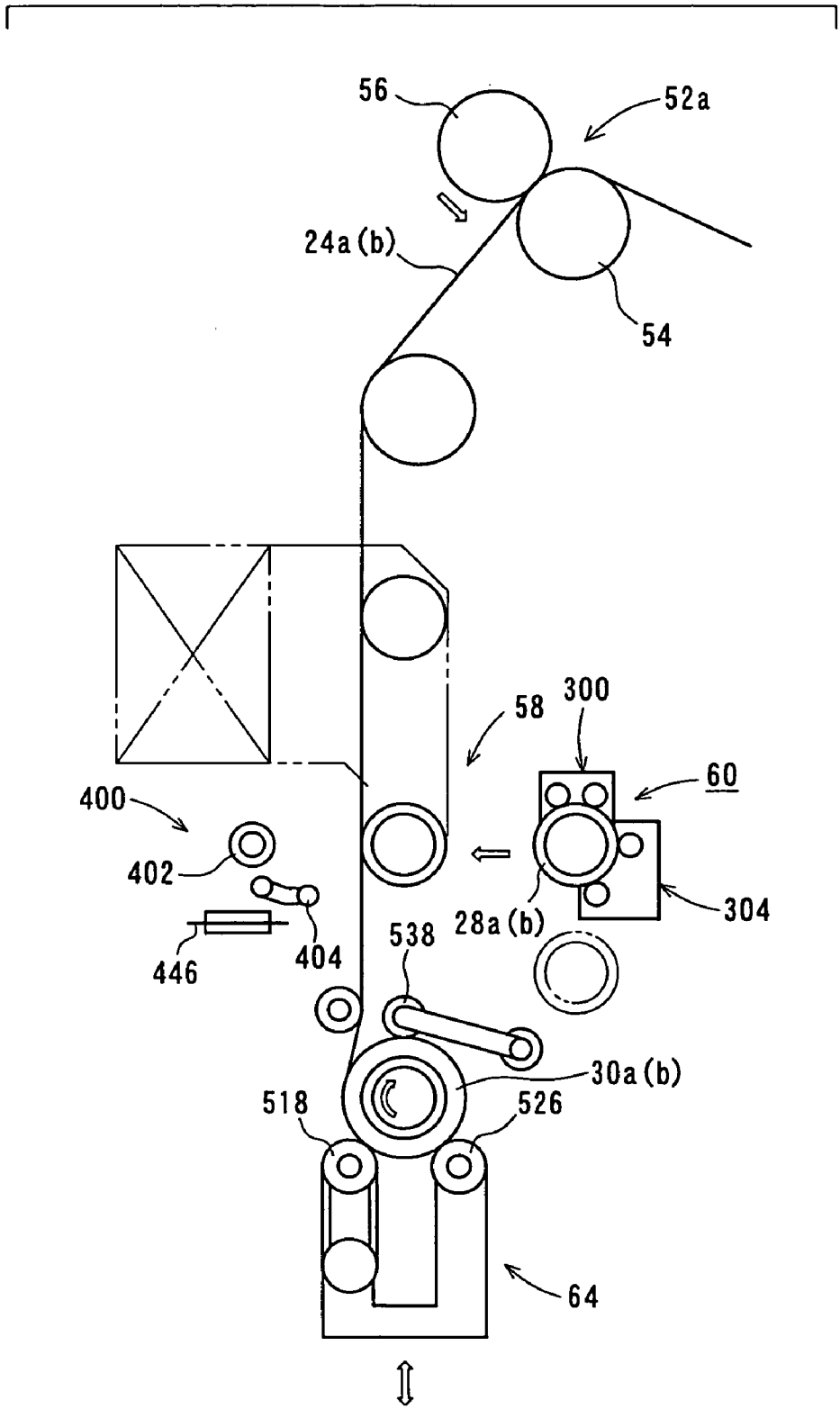
FIG. 16 is a view illustrative of the manner in which a film roll made of the elongate film wound around the core is discharged.

When the elongate films 24*a*, 24*b* are wound to a given length around the cores 28*a*, 28*b* by the core rotating mechanism 58, as shown in FIG. 16, the nip roller 56 is moved toward the backup roller 54, suppressing tension variations in an upstream film path portion, and the product receiving mechanism 64 is elevated. On the product receiving mechanism 64, the rolls 30*a*, 30*b* are held by the rider roller 538, the ejection roller 518, and the free roller 526. The servomotor 502 is energized to rotate the balls crew 506, causing the block 514 to lower the rolls 30*a*, 30*b* to a vertical cutting position. At this time, since the rolls 30*a*, 30*b* are lowered while unwinding the elongate films 24*a*, 24*b*, the elongate films 24*a*, 24*b* are kept under tension.

Then, the drive unit 202 is actuated to move the unit body 200 forward in the direction indicated by the arrow C2, and new cores 28*a*, 28*b* are held by the core rotating mechanism 58. The unit body 406 is moved forward to cause the winding nip roller 402 to press the elongate films 24*a*, 24*b* against the outer circumferential surfaces of the cores 28*a*, 28*b*.

Then, as shown in FIG. 10, the rodless cylinder 430 of the cutting mechanism 66 is actuated, moving the base member 434 in unison therewith in the transverse directions of the film, i.e., in the directions indicated by the arrow D. Therefore, the first pinion 440 meshing with the rack 438 extending in the directions indicated by the arrow D and the second pinion 442 meshing with the first pinion 440 are rotated to rotate and move the cross cutter blade 446 in the directions indicated by the arrow D, cross-cutting the elongate films 24*a*, 24*b* transversely while they are being guided by the sorting guide 448.

Figure 17:
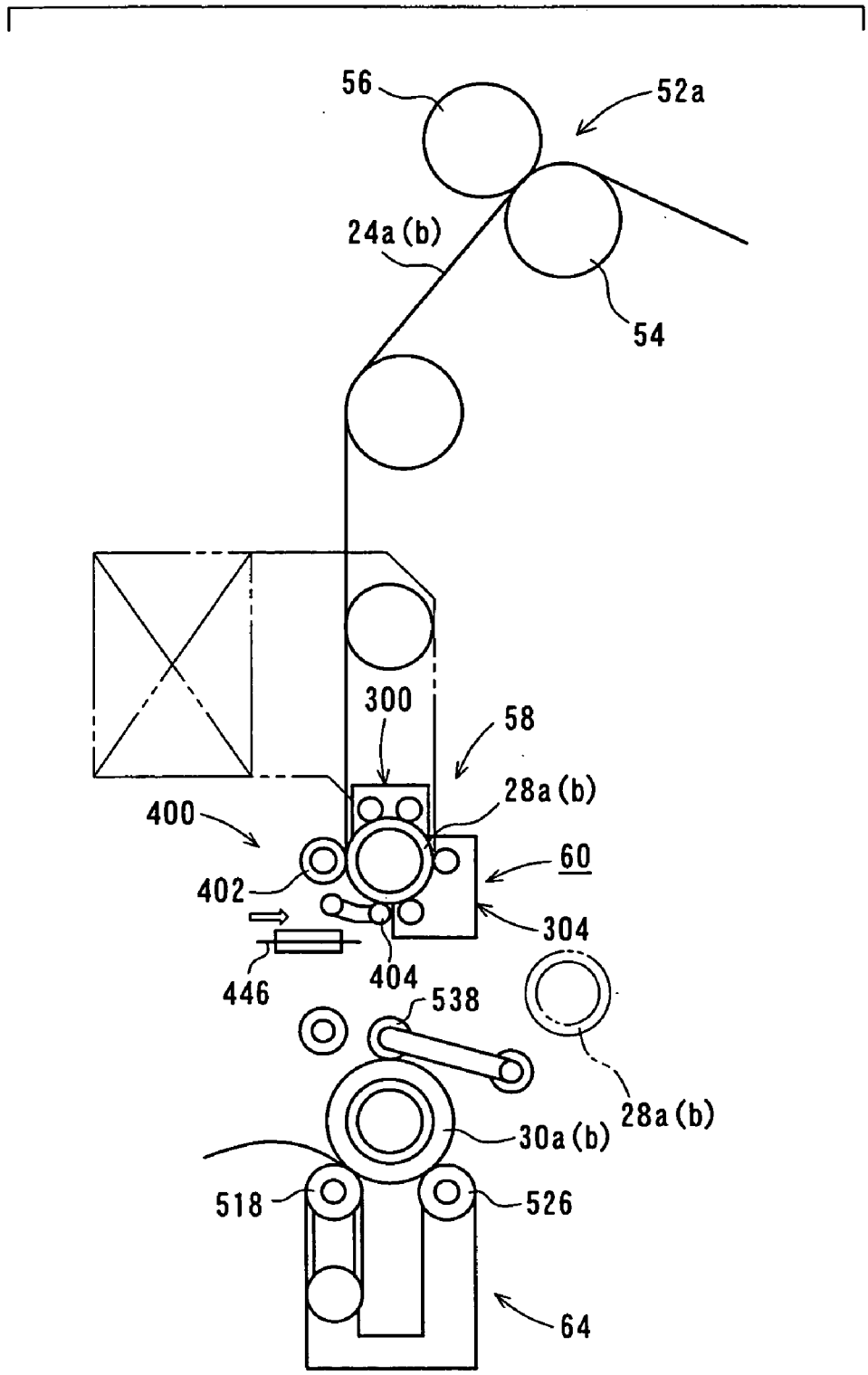
FIG. 17 is a view illustrative of the manner in which the elongate film is cut from the film roll.

After the elongate films 24*a*, 24*b* are cut, as shown in FIG. 9, the cylinder 414 is actuated to move the lower winding roller 404 in unison with the lower plate 410 forward in the direction indicated by the arrow C1. Therefore, as shown in FIG. 17, the cut leading end portions of the elongate films 24*a*, 24*b* are wound around the cores 28*a*, 28*b* through about 90°.

Figure 18:
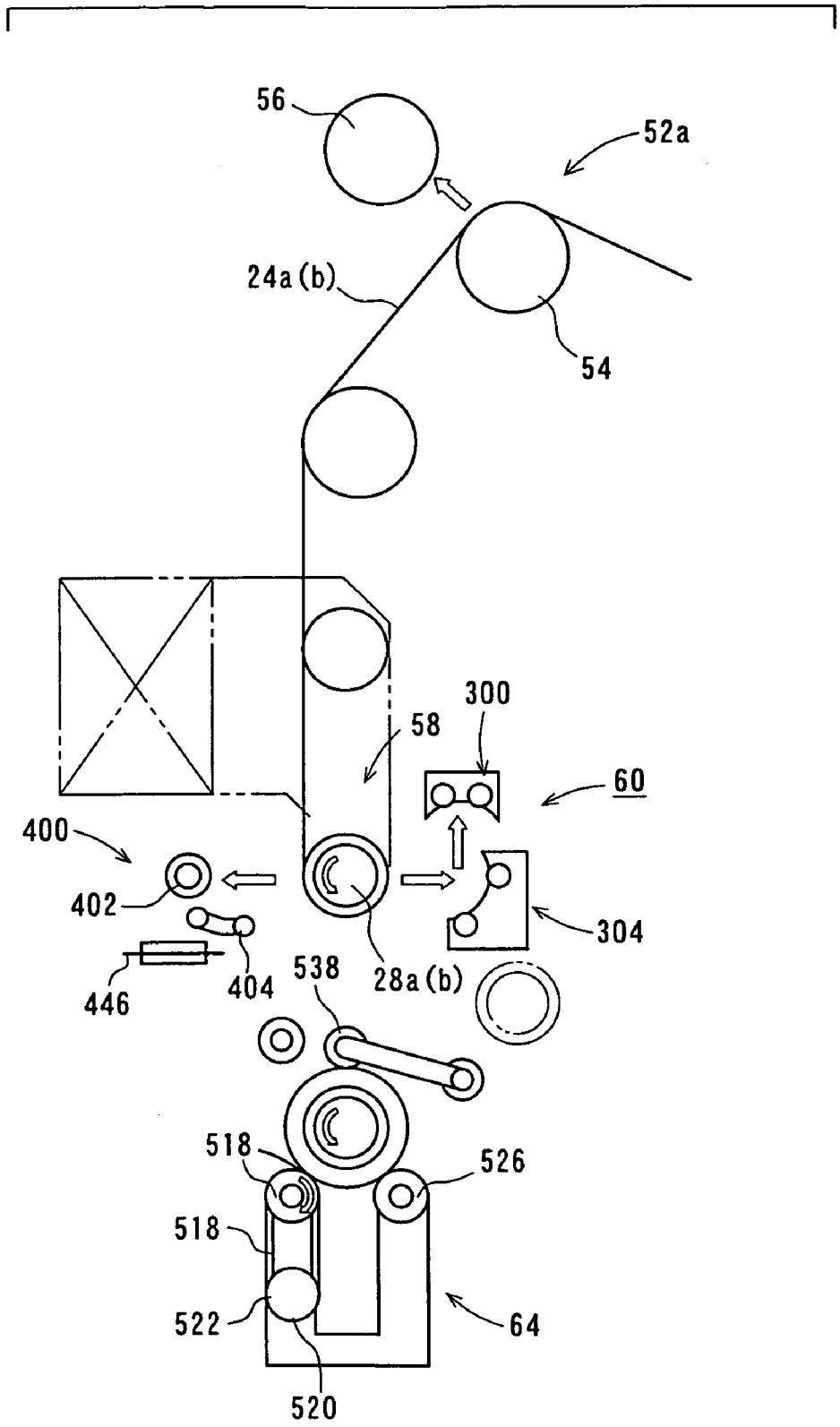
FIG. 18 is a view illustrative of the manner in which the end of the cut elongate film is wound, producing the film roll.

Then, as shown in FIG. 18, the elongate films 24*a*, 24*b* are wound around the cores 28*a*, 28*b*. On the product receiving mechanism 64, the servomotor 520 is energized to rotate the product in the winding direction, winding the cut trailing ends of the elongate films 24*a*, 24*b* to a suitable length. The product is transferred from the product receiving mechanism 64 to the conveyor 528, which supplies the product to a next process.

In the second embodiment, as shown in FIG. 8, the first and second free rollers 320*a*, 320*b* are pressed against the outer circumferential surfaces of the cores 28*a*, 28*b*, and the direction in which the first and second free rollers 320*a*, 320*b* are pressed, i.e., the direction indicated by the arrow V2, is opposite to the direction in which the elongate films 24*a*, 24*b* wound around the cores 28*a*. 28*b* are tensioned, i.e., the direction indicated by the arrow V1.

Consequently, the first and second free rollers 320*a*, 320*b* are capable of applying pressing forces to the cores 28*a*, 28*b* while counterbalancing the tension that is applied to the cores 28*a*, 28*b* when the elongate films 24*a*, 24*b* are wound therearound, thus reliably preventing the cores 28*a*, 28*b* from being flexed. Thus, the elongate films 24*a*, 24*b* are prevented from being transported unstably, and are smoothly and reliably wound around the cores 28*a*, 28*b*, providing a stable wound configuration.

The first and second free rollers 320*a*, 320*b* are positioned at equal distances K from the hypothetical reference line LV. Therefore, the first and second free rollers 320*a*, 320*b* are stably and firmly supported on the output circumferential surfaces of the cores 28*a*, 28*b*, and the block 317 on which the first and second free rollers 320*a*, 320*b* are mounted does not need to rely on its own rigidity, allowing the gap 319 to be maintained reliably between the block 317 and the cores 28*a*, 28*b*.

The elongate films 24*a*, 24*b* can thus smoothly be wound along the gap 319 and hence can be wound efficiently and highly accurately. The fourth free roller 334 is disposed in substantially opposite relation to the first and second free rollers 320*a*, 320*b* about the cores 28*a*, 28*b*, thereby reliably supporting the cores 28*a*, 28*b*.

The third free roller 332 and the winding nip roller 402 are disposed on the hypothetical reference line LH in opposite relation to each other about the cores 28*a*, 28*b*. Therefore, pressing forces applied by the third free roller 332 and the winding nip roller 402 are held in equilibrium, preventing the cores 28*a*, 28*b* from being flexed along the hypothetical reference line LH.

Figure 19:
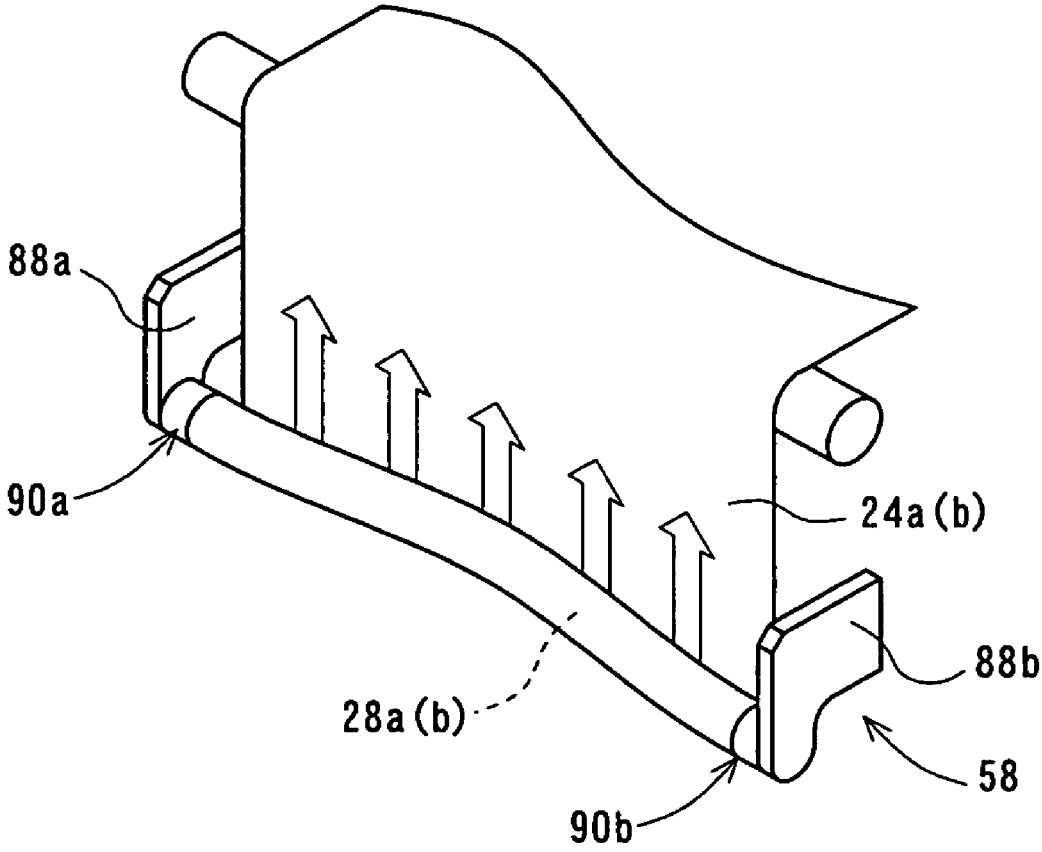
FIG. 19 is a perspective view showing the manner in which the elongate film is wound around the core without using the block wrapper.
Figure 20:
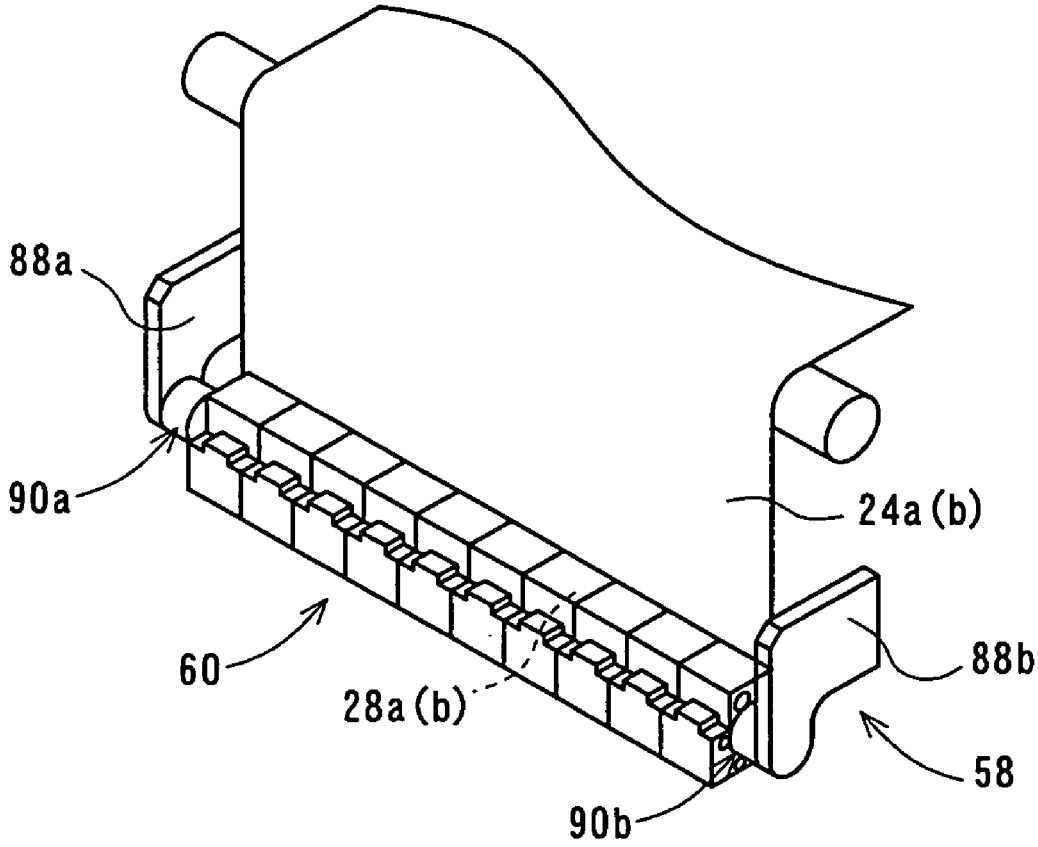
FIG. 20 is a perspective view showing the manner in which the elongate film is wound around the core using the block wrapper.

A predetermined number of block wrappers 60 corresponding to the axial length of the cores 28*a*, 28*b* are arrayed in the axial direction of the cores 28*a*, 28*b*, and apply pressing forces to the cores 28*a*, 28*b* over their entire length. Accordingly, uniform pressing forces can be applied to the cores 28*a*, 28*b* in the entire axial direction, so that the cores 28*a*, 28*b* can be maintained linearly over their entire length. Specifically, as shown in FIG. 19, if the cores 28*a*, 28*b* held by only the core chucks 90*a*, 90*b* are rotated by the core rotating mechanism 58 to wind the elongate films 24*a*, 24*b* around the cores 28*a*, 28*b*, the cores 28*a*, 28*b* are liable to be largely flexed in their central region. However, as shown in FIG. 20, when the cores 28*a*, 28*b* are rotated while pressing forces are being applied to the cores 28*a*, 28*b* over their entire length by the block wrappers 60, the cores 28*a*, 28*b* can be maintained linearly over their entire length, preventing the wound configuration of the elongate films 24*a*, 24*b* from being disturbed.

By setting dimensions of the gaps 319, 331 between the blocks 317, 329 and the cores 28*a*, 28*b*, it is possible to wind the elongate films 24*a*, 24*b* neatly around the cores 28*a*, 28*b*. Specifically, when the base of the elongate films 24*a*, 24*b* was made of PET, the elongate films 24*a*, 24*b* had a thickness of 0.1 mm, the outside diameter of the cores 28*a*, 28*b* was in the range from 50 mm to 90 mm, and the gaps 319, 331 were in the range from 0.1 mm to 0.8 mm, i.e., in the range from the thickness of the elongate films 24*a*, 24*b* to 0.8 mm, a stable wound configuration was obtained.

When the gaps 319, 331 were in the range from 0.8 mm to 1.2 mm, the elongate films 24*a*, 24*b* tended to float from the cores 28*a*, 28*b*. When the gaps 319, 331 were greater than 1.2 mm, the wound state was unstable, and a winding failure was caused. Therefore, the gaps 319, 331 should preferably be in the range from the thickness of the elongate films 24*a*, 24*b* to 0.8 mm.

According to the second embodiment, furthermore, the block 317 with the first and second free rollers 320*a*, 320*b* mounted thereon is movable toward and away from the cores 28*a*, 28*b* by an actuator with a pressing force adjusting function, e.g., the vertical cylinder 310. The tension of the elongate films 24*a*, 24*b* when they are wound around the cores 28*a*, 28*b* is in the range from 9.8 N (Newton) to 29.4 N (Newton) per 100 mm of the film, and is controlled by the torque produced by the servomotor 92 of the core rotating mechanism 58. The servomotor 92 may be replaced with a combination of an induction motor and a powder brake, a combination of an induction motor and a hysteresis clutch, or a combination of a speed-controlled motor and a dancer.

The pressing forces of the upper wrapper 300 are set by a regulator to be of the same value as the above tension value. For example, in the case where the block wrapper 60 has a width of 100 mm, the cylinder 310 has a bore diameter of 10 mm, and the upper wrapper 300 has a weight of 4.9 N (Newton), if the film tension value is 19.6 N (Newton) per 100 mm, then the pressing forces of the upper wrapper 300 are $18.6\times10^4$ Pa (Pascal).

The cores 28*a*, 28*b* are apt to have a more flexible region in the axial direction thereof. If, for example, the pressing forces of the block wrapper 60 disposed at the centers of the cores 28*a*, 28*b* are higher than those of the other block wrappers 60, then the cores 28*a*, 28*b* can accurately be corrected out of their flexed configuration.

If there is employed a mechanism capable of automatically controlling a pressure in ganged relation to the set tension value of the elongate films 24*a*, 24*b* when they are wound, then transverse film sizes can be changed automatically when the tension is changed according to transverse film size. By individually controlling the cylinders 310 of the respective block wrappers 60, the cores 28*a*, 28*b* can be pressed so as to be slightly flexed in a direction opposite to the direction in which it is flexed under tension. Accordingly, the stability with which to transport the elongate films 24*a*, 24*b* is increased to reliably obtain a stable wound configuration.

Figure 21:
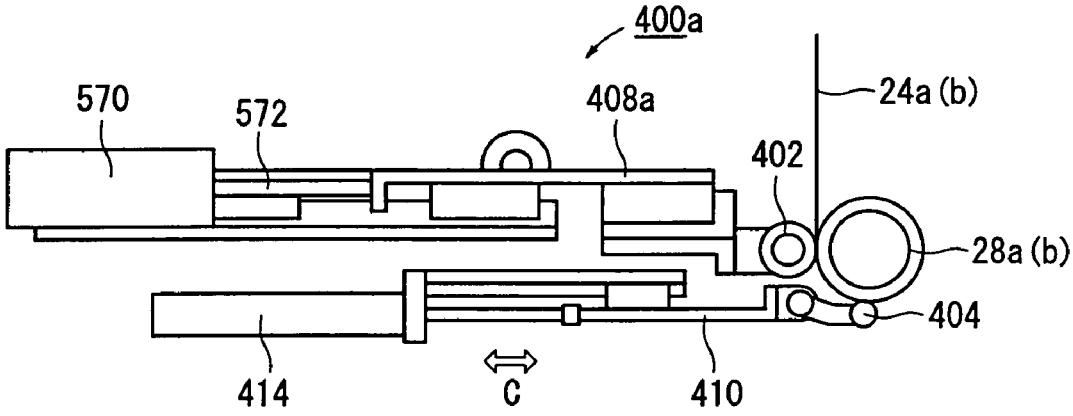
FIG. 21 is a view of another winding nip roller unit.
Figure 22:
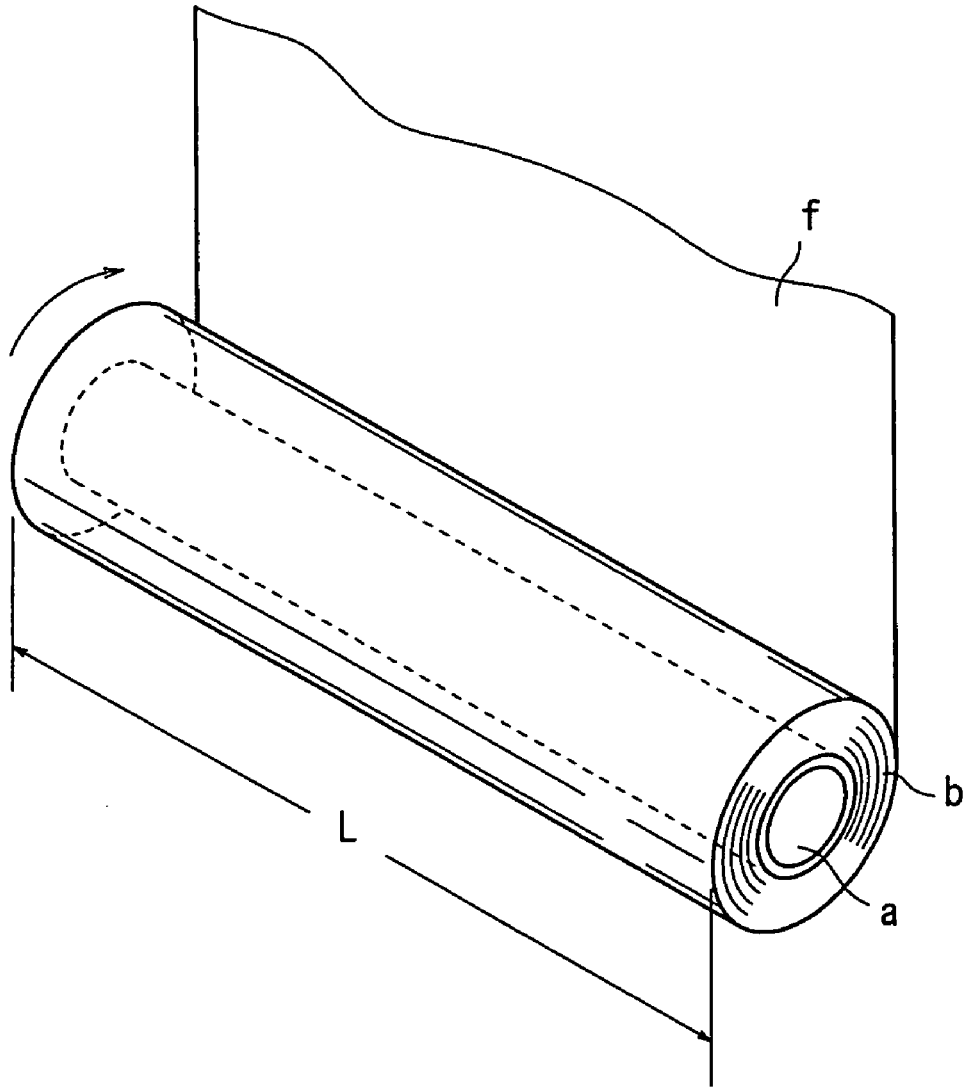
FIG. 22 is a perspective view illustrative of the manner in which a roll is produced by winding a web around a core.

In the second embodiment, the winding nip roller unit 400 is employed. However, the winding nip roller unit 400 may be replaced with a winding nip roller unit 400*a* shown in FIG. 21. The winding nip roller unit 400*a* has a cylinder 570 for moving the winding nip roller 402 in the directions indicated by the arrow C. The cylinder 570 has a rod 572 extending therefrom and coupled to a movable upper plate 408*a* supporting the winding nip roller 402 thereon. The winding nip roller 402 is movable in unison with the movable upper plate 408*a* when the cylinder 570 is actuated.

The elongate films 24*a* through 24*d* have been described as a web. However, the present invention is also applicable to any of various webs including resin sheets, paper, etc.

According to the present invention, as described above, the web is initially wound around the core under a low tension, thereafter wound under a tension that increases at a given rate, and then wound under a tension that progressively decreases from the high tension. The web thus wound into a roll is not damaged and the roll is in a neatly wound state free of edge undulations or irregularities on its end faces.

The length to which the web is wound around the core under a low tension is set so as to correspond to the length of the core, so that the web can be neatly wound around the core without the danger of the core becoming flexed.

According to the present invention, the core is rotated while a plurality of rollers and blocks are disposed around the core, and the rollers and blocks are retracted away from the core successively from regions where the leading end of the web has passed. Accordingly, only the leading end of the web is kept on the outer circumferential surface of the core, and the web is not loosened under the tension of the web. A high-quality wound product with a desired wound configuration maintained reliably can efficiently be obtained through a simple process.

According to the present invention, furthermore, there is disposed a movable pressing roller which is pressed against the core in a direction opposite to the direction in which the tension of at least the web is applied, to keep the tension of the web and the pressing forces applied by the pressing roller in equilibrium. Consequently, when the web is wound around the core, the core is prevented from being flexed under the tension of the web, making it possible to reliably obtain a stable wound configuration with a simple arrangement.

Although certain preferred embodiments of the present invention have been shown and described in detail, it should be understood that various changes and modifications may be made therein without departing from the scope of the appended claims.

What is claimed is:

1. A method of winding a web around a core at a high speed, comprising the steps of:

winding the web to a given length around the core under a low tension, then progressively increasing the tension of the web at a gradual predetermined rate until reaching a high tension, and thereafter winding the web under a tension which is being reduced from the high tension, wherein the progressively increasing of the tension at the gradual predetermined rate is done by increasing a winding speed of the web.

2. The method according to claim 1, wherein said given length to which the web is wound around the core under the low tension is longer if the core is longer and shorter if the core is shorter.

3. The method according to claim 1, wherein said given length to which the web is wound around the core under the low tension is set to a value up to 15% of the length to which the web is to be wound.

4. A method of winding a web around a core at a high speed, comprising the steps of:

winding the web to a given length, which corresponds to the length of the core, around the core under a low tension, then gradually increasing the tension of the web to a high tension, and thereafter winding the web under a tension which is being reduced from the high tension, wherein the gradually increasing of the tension is done by increasing a winding speed of the web.

5. The method according to claim 4, wherein said given length to which the web is wound around the core under the low tension is longer if the core is longer and shorter if the core is shorter.

6. The method according to claim 4, wherein said given length to which the web is wound around the core under the low tension is set to a value up to 15 % of the length to which the web is to be wound.

7. An apparatus for winding a web around a core at a high speed, comprising:

winding tension storing means for storing a winding tension corresponding to the length to which the web is wound around the core;

torque converting means for reading said winding tension from said winding tension storing means and converting the read winding tension into a winding torque; and core rotation control means for controlling rotation of the core according to said winding torque;

said winding tension being set so as to wind the web to a given length around the core under a low tension, then progressively increase the tension of the web at a predetermined gradual rate until reaching a high tension, and thereafter wind the web under a tension which is being reduced from the high tension, wherein a winding speed of the web is increased during a period that the tension of said web is progressively increased to said high tension.

8. The apparatus according to claim 7, including simultaneously winding a plurality of webs around respective cores, wherein said winding tension storage means comprises means for storing winding tensions of the respective webs, and said core rotation control means comprises means for independently controlling rotation of the cores respectively according to said winding torques corresponding to said winding tensions.

9. An apparatus for winding a web around a core at a high speed, comprising:

winding tension storing means for storing a winding tension corresponding to the length to which the web is wound around the core;

torque converting means for reading said winding tension from said winding tension storing means and converting the read winding tension into a winding torque; and core rotation control means for controlling rotation of the core according to said winding torque;

said winding tension being set so as to wind the web to a given length, which corresponds to the length of the core, around the core under a low tension, then gradually increase the tension of the web to a high tension, and thereafter wind the web under a tension which is being reduced from the high tension, wherein a winding speed of the web is increased during a period that the tension of said web is gradually increased to said high tension.

10. The apparatus according to claim 9, including simultaneously winding a plurality of webs around respective cores, wherein said winding tension storing means comprises means for storing winding tensions of the respective webs, and said core rotation control means comprises means for independently controlling rotation of the cores respectively according to said winding torques corresponding to said winding tensions.

* * * * *